US010053646B2

(12) United States Patent
Schiff-Deb et al.

(10) Patent No.: US 10,053,646 B2
(45) Date of Patent: Aug. 21, 2018

(54) MICROALGAL COMPOSITIONS AND USES THEREOF

(71) Applicant: Corbion Biotech, Inc., South San Francisco, CA (US)

(72) Inventors: Celine Schiff-Deb, South San Francisco, CA (US); Adrienne McKee, South San Francisco, CA (US); John Piechocki, South San Francisco, CA (US); Staci Springer, South San Francisco, CA (US); Garrett Sell, South San Francisco, CA (US); Bryce A. R. Sullivan, South San Francisco, CA (US)

(73) Assignee: Corbion Biotech, Inc., South San Francisco, CA (US)

( * ) Notice: Subject to any disclaimer, the term of this patent is extended or adjusted under 35 U.S.C. 154(b) by 134 days.

(21) Appl. No.: 15/080,458

(22) Filed: Mar. 24, 2016

(65) Prior Publication Data

US 2016/0281021 A1 Sep. 29, 2016

Related U.S. Application Data

(60) Provisional application No. 62/137,784, filed on Mar. 24, 2015, provisional application No. 62/162,553, filed on May 15, 2015, provisional application No. 62/175,014, filed on Jun. 12, 2015.

(51) Int. Cl.

| | |
|---|---|
| ***C10M 173/02*** | (2006.01) |
| ***C10M 159/02*** | (2006.01) |
| ***C10M 129/40*** | (2006.01) |
| ***C10M 129/20*** | (2006.01) |
| ***C10M 159/08*** | (2006.01) |
| ***C10M 169/04*** | (2006.01) |
| ***C10M 173/00*** | (2006.01) |
| *C10N 40/22* | (2006.01) |
| *C10N 40/24* | (2006.01) |
| *C10N 50/08* | (2006.01) |

(52) U.S. Cl.

CPC ..... *C10M 159/02* (2013.01); *C10M 129/20* (2013.01); *C10M 129/40* (2013.01); *C10M 159/08* (2013.01); *C10M 169/04* (2013.01); *C10M 173/00* (2013.01); *C10M 2201/041* (2013.01); *C10M 2201/061* (2013.01); *C10M 2201/065* (2013.01); *C10M 2201/066* (2013.01); *C10M 2203/1006* (2013.01); *C10M 2203/1065* (2013.01); *C10M 2207/046* (2013.01); *C10M 2207/2805* (2013.01); *C10M 2207/301* (2013.01); *C10M 2207/40* (2013.01); *C10M 2207/401* (2013.01); *C10M 2207/404* (2013.01); *C10M 2209/1033* (2013.01); *C10M 2209/1045* (2013.01); *C10M 2209/1055* (2013.01); *C10N 2040/22* (2013.01); *C10N 2040/24* (2013.01); *C10N 2050/08* (2013.01); *C10N 2210/04* (2013.01); *C10N 2210/06* (2013.01); *C10N 2220/024* (2013.01); *C10N 2220/08* (2013.01); *C10N 2220/082* (2013.01); *C10N 2220/10* (2013.01); *C10N 2230/06* (2013.01); *C10N 2230/62* (2013.01); *C10N 2230/64* (2013.01); *C10N 2240/00* (2013.01); *C10N 2240/02* (2013.01); *C10N 2240/04* (2013.01); *C10N 2240/08* (2013.01); *C10N 2240/10* (2013.01); *C10N 2240/12* (2013.01); *C10N 2240/20* (2013.01); *C10N 2240/30* (2013.01); *C10N 2240/40* (2013.01); *C10N 2240/401* (2013.01); *C10N 2240/402* (2013.01); *C10N 2240/52* (2013.01); *C10N 2240/58* (2013.01); *C10N 2250/08* (2013.01); *C10N 2250/10* (2013.01)

(58) Field of Classification Search

CPC ..... C10M 2207/40; C10M 2207/046; C10N 2040/22

USPC ..... 508/216

See application file for complete search history.

(56) References Cited

U.S. PATENT DOCUMENTS

| | | | |
|---|---|---|---|
| 2,639,239 | A | 5/1953 | Elliott |
| 3,284,441 | A | 11/1966 | Bishop et al. |
| 3,345,358 | A | 10/1967 | Inklaar |
| 3,598,181 | A | 8/1971 | Wegner et al. |
| 3,650,326 | A | 3/1972 | Hitzman |
| 3,723,413 | A | 3/1973 | Chatterjee et al. |
| 3,761,410 | A | 9/1973 | Mondshine et al. |
| 3,958,364 | A | 5/1976 | Schenck et al. |
| 3,971,852 | A | 7/1976 | Brenner et al. |
| 4,063,603 | A | 12/1977 | Rayborn |
| 4,079,544 | A | 3/1978 | Savins |
| 4,087,936 | A | 5/1978 | Savins et al. |

(Continued)

FOREIGN PATENT DOCUMENTS

| | | |
|---|---|---|
| AU | 200185511 A1 | 1/2002 |
| CA | 1 317 540 C | 5/1993 |

(Continued)

OTHER PUBLICATIONS

International Search Report, dated Jun. 8, 2016, for International Application No. PCT/US2016/024106, filed Mar. 24, 2016, 5 pages.

Albino et al. (2010) "Partial Characterization of Biosurfactant Produced under Anaerobic Conditions by *Pseudomonas* sp Anbiosurf-1," *Advanced Materials Research*, 93-94:623-626.

Lin et al. (1994) "Structural and immunological characterization of a biosurfactant produced by Bacillus licheniformis JF-2," *Applied and Environmental Microbiology*, 60(1):31-38.

McInerney et al. (1990) Properties of the biosurfactant produced by *Bacillus licheniformis* strain JF-2, *Journal of Industrial Microbiology*, 5(2-3):95-101.

McInerney et al. (2005) "Development of Microorganisms with Improved Transport and Biosurfactant Activity for Enhanced Oil Recovery," *Final Report, Department of Botany and Microbiology and Department of Petroleum Engineering, University of Oklahoma*, 180 pages.

(Continued)

*Primary Examiner* — Vishal Vasisth

(74) *Attorney, Agent, or Firm* — Weaver Austin Villeneuve & Sampson, LLP.

(57) ABSTRACT

Provided are microalgal compositions and methods for their use. The microalgal compositions include lubricants that find use in industrial and other applications.

20 Claims, No Drawings

(56) References Cited

U.S. PATENT DOCUMENTS

| | | | |
|---|---|---|---|
| 4,181,617 | A | 1/1980 | Elrod et al. |
| 4,233,438 | A | 11/1980 | Myers et al. |
| 4,356,096 | A | 10/1982 | Cowan et al. |
| 4,374,737 | A | 2/1983 | Larson et al. |
| 4,522,261 | A | 6/1985 | McInerney et al. |
| 4,631,136 | A | 12/1986 | Jones, III |
| 4,689,408 | A | 8/1987 | Gelman et al. |
| 5,278,203 | A | 1/1994 | Harms |
| 5,314,031 | A | 5/1994 | Hale et al. |
| 5,338,471 | A | 8/1994 | Lal |
| 5,362,713 | A | 11/1994 | Westland et al. |
| 5,658,860 | A | 8/1997 | Clark et al. |
| 5,707,940 | A | 1/1998 | Bush et al. |
| 5,789,349 | A | 8/1998 | Patel |
| 6,180,376 | B1 | 1/2001 | Liddell |
| 6,422,326 | B1 | 7/2002 | Brookey et al. |
| 6,765,042 | B1 | 7/2004 | Thornton et al. |
| 6,770,601 | B1 | 8/2004 | Brookey |
| 7,199,085 | B2 | 4/2007 | Rea et al. |
| 7,485,719 | B2 | 2/2009 | Abe et al. |
| 7,723,272 | B2 | 5/2010 | Crews et al. |
| 2001/0027880 | A1 | 10/2001 | Brookey |
| 2002/0076803 | A1 | 6/2002 | Crews |
| 2003/0032562 | A1 | 2/2003 | Crossman et al. |
| 2004/0033557 | A1 | 2/2004 | Scott et al. |
| 2005/0002825 | A1 | 1/2005 | Crescenzi et al. |
| 2005/0197255 | A1 | 9/2005 | Otto et al. |
| 2007/0032386 | A1 | 2/2007 | Abad et al. |
| 2007/0248531 | A1 | 10/2007 | Debryun et al. |
| 2008/0070805 | A1 | 3/2008 | Munoz et al. |
| 2009/0209438 | A1 | 8/2009 | Thieme et al. |
| 2009/0305942 | A1 | 12/2009 | Day et al. |
| 2010/0035309 | A1 | 2/2010 | Havemen et al. |
| 2010/0093046 | A1 | 4/2010 | Remmereit et al. |
| 2010/0120643 | A1 | 5/2010 | Brown et al. |
| 2010/0233761 | A1 | 9/2010 | Czartoski et al. |
| 2010/0248321 | A1 | 9/2010 | Steaffens et al. |
| 2010/0248322 | A1 | 9/2010 | Pfeiffer et al. |
| 2011/0117067 | A1 | 5/2011 | Esteghlalian et al. |
| 2011/0284215 | A1 | 11/2011 | Pfeiffer et al. |
| 2011/0294174 | A1 | 12/2011 | Franklin et al. |
| 2012/0021495 | A1 | 1/2012 | Vanzin |
| 2012/0119862 | A1 | 5/2012 | Franklin et al. |
| 2012/0247763 | A1 | 10/2012 | Rakitsky et al. |
| 2013/0072406 | A1* | 3/2013 | Sueda ..... C01G 9/00 508/170 |
| 2013/0338385 | A1 | 12/2013 | Franklin et al. |
| 2014/0215654 | A1 | 7/2014 | Davis |
| 2014/0256600 | A1 | 9/2014 | Dillon et al. |
| 2014/0273168 | A1 | 9/2014 | Dillon et al. |
| 2015/0247081 | A1 | 9/2015 | Dillon et al. |
| 2016/0002521 | A1 | 1/2016 | Dillon et al. |
| 2016/0177164 | A1 | 6/2016 | Dillon et al. |

FOREIGN PATENT DOCUMENTS

| | | | |
|---|---|---|---|
| CA | 2 290 278 | C | 7/2003 |
| CN | 1275429 | A | 12/2000 |
| CN | 1342189 | A | 3/2002 |
| CN | 1580486 | A | 2/2005 |
| CN | 101240703 | A | 8/2008 |
| CN | 101765661 | A | 6/2010 |
| CN | 101948786 | A | 1/2011 |
| IN | 20040168211 | | 8/2006 |
| IN | 197554 | B | 11/2006 |
| WO | WO 98/53698 | A1 | 12/1998 |
| WO | WO 00/47691 | | 8/2000 |
| WO | WO 02/18486 | A1 | 3/2002 |
| WO | WO 02/079359 | A1 | 10/2002 |
| WO | WO 2004/030788 | A2 | 4/2004 |
| WO | WO 2005/005773 | A2 | 1/2005 |
| WO | WO 2006/102042 | A1 | 9/2006 |
| WO | WO 2006/102044 | A1 | 9/2006 |
| WO | WO 2008/018966 | A2 | 2/2008 |
| WO | WO 2008/044158 | A2 | 4/2008 |
| WO | WO 2008/091956 | A2 | 7/2008 |
| WO | WO 2008/151149 | A2 | 12/2008 |
| WO | WO 2009/009382 | A2 | 1/2009 |
| WO | WO 2009/104108 | A1 | 8/2009 |
| WO | WO 2010/047705 | A1 | 4/2010 |
| WO | WO 2010/063031 | A2 | 6/2010 |
| WO | WO 2010/063032 | A2 | 6/2010 |
| WO | WO 2011/012164 | A1 | 2/2011 |
| WO | WO 2011/025984 | A1 | 3/2011 |
| WO | WO 2012/116230 | A1 | 8/2012 |
| WO | WO 2012/135756 | A2 | 10/2012 |
| WO | 2014-138593 | A2 | 9/2014 |
| WO | WO 2016/004401 | A1 | 1/2016 |
| WO | WO 2016/154490 | A1 | 9/2016 |

OTHER PUBLICATIONS

Perfumo et al. (2008) "Possibilities and Challenges for Biosurfactants Uses in Petroleum Industry," *Biosurfectants, Landes Bioscience, Electronic publication*, 11 pages.

Shavandi et al. (2011) "Emulsification potential of a newly isolated biosurfactant-producing bacterium, *Rhodococcus* sp. strain TA6," *Colloids and Surfaces B: Biointerfaces*, 82(2):477-482.

Youssef et al. (2005)"Importance of 3-Hydroxy Fatty Acid Composition of Lipopeptides for Biosurfactant Activity," *Applied and Environmental Microbiology*, 71(12):7690-7695.

U.S. Office Action, dated Mar. 10, 2015, issued in U.S. Appl. No. 13/436,543.

U.S. Final Office Action, dated Jul. 16, 2015, issued in U.S. Appl. No. 13/436,543.

U.S. Office Action, dated Oct. 28, 2015, issued in U.S. Appl. No. 13/436,543.

U.S. Final Office Action, dated Mar. 8, 2016, issued in U.S. Appl. No. 13/436,543.

U.S. Office Action, dated Aug. 25, 2016, issued in U.S. Appl. No. 13/436,543.

U.S. Office Action, dated Aug. 12, 2015, issued in U.S. Appl. No. 14/200,017.

U.S. Office Action [Requirement for Restriction/Election], dated Sep. 26, 2017, issued in U.S. Appl. No. 15/043,420.

U.S. Office Action, dated Mar. 10, 2016, issued in U.S. Appl. No. 14/714,288.

U.S. Office Action, dated Oct. 18, 2016, issued in U.S. Appl. No. 14/790,781.

PCT International Search Report and Written Opinion dated Oct. 30, 2012 issued in PCT/US2012/031674 [WO 2012/135756].

PCT International Preliminary Report on Patentability and Written Opinion dated Oct. 10, 2013 issued in PCT/US2012/031674 [WO 2012/135756].

Australian Patent Examination Report No. 1 dated Nov. 20, 2015 issued in AU 2012236141.

Chinese First Office Action dated Jul. 15, 2015 issued in CN 201280021912.6.

Chinese Second Office Action dated Apr. 5, 2016 issued in CN 201280021912.6.

Chinese Third Office Action dated Dec. 22, 2016 issued in CN 201280021912.6.

Eurasian Office Action dated Dec. 2, 2013 issued in EA201391445.

Eurasian Second Office Action dated Jul. 7, 2015 issued in EA201391445.

Eurasian Third Office Action dated Dec. 9, 2015 issued in EA201391445.

Eurasian Fourth Office Action dated Jun. 15, 2016 issued in EA201391445.

Eurasian Fifth Office Action dated Oct. 18, 2016 issued in EA201391445.

European Supplementary Search Report dated Jul. 22, 2014 issued in EP 12 76 5478.8.

Qatar Office Action dated Aug. 20, 2016 issued in QA/201310/00237.

PCT Invitation to Pay Additional Fees and, Where Applicable, Protest Fee dated Jun. 20, 2014 issued in PCT/US2014/021794 [WO 2014/138593].

(56) References Cited

OTHER PUBLICATIONS

PCT International Search Report and Written Opinion dated Jan. 21, 2015 issued in PCT/US2014/021794 [WO 2014/138593].
PCT International Preliminary Report on Patentability and Written Opinion dated Sep. 17, 2015 issued in PCT/US2014/021794 [WO 2014/138593].
Australian Patent Examination Report No. 1 dated Nov. 28, 2016 issued in AU 2014225439.
European Office Action dated Jan. 13, 2017 issued in EP 14 714 058.6.
Saudi Arabia Office Action dated Oct. 11, 2016, issued in SA 515360998.
Vietnam Office Action dated Nov. 9, 2015 issued in VN 1-2015-03742.
PCT International Search Report and Written Opinion dated Sep. 24, 2015 issued in PCT/US2015/039130.
PCT International Preliminary Report on Patentability and Written Opinion dated Jan. 12, 2017 issued in PCT/US2015/039130.
PCT International Search Report and Written Opinion dated Jun. 8, 2016 issued in PCT/US2016/024106.
PCT International Preliminary Report on Patentability and Written Opinion dated Oct. 5, 2017 issued in PCT/US2016/024106.
Al-Sulaimani et al. (2011)"Microbial biotechnology for enhancing oil recovery: Current developments and future prospects," *Invited Review, Biotechnol. Bioinf. Bioeng., Society for Applied Biotechnology*, 1(2): 147-158.
Armstrong et al. (Jan. 20, 2012) "Microbial Enhanced Oil Recovery in Fractional-Wet Systems: A Pore-Scale Investigation," *Transp Porous Med, Electronic publication*, 17 pages.
Belkin et al. (2005) "How Aphron Drilling Fluids Work," 2005 SPE Annual Technical Conference and Exhibition held in Dallas, Texas, USA, 7 pages.
Hou et al. (2005) "The Mechanism and Application of MEOR by Brevibacillus Brevis and Bacillus Cereus in Daqing Oilfield," *SPE International Improved Oil Recovery Conference in Asia Pacific, Kuala Lumpur, Malaysia, Society of Petroleum Engineers*, [Abstract Only, 2 pages].
Maier et al. (2000) "*Pseudomonas aeruginosa* rhamnolipids:biosynthesis and potential applications," *Applied Microbiology and Biotechnology*, 54(5):625-633.
Metzger et al., (Feb. 1, 2005) "*Botryococcus braunii*: a rich source for hydrocarbons and related ether lipids," *Appl Microbiol Biotechnol*, 66(5):486-496.
Partidas et al. (1998) "Microbes aid heavy oil recovery in Venezuela," *Oil and Gas Journal*, 96(24):62-64.
Pellet-Beaucour et al., (2002) "Experimental and analytical study of friction forces during microtunneling operations," *Tunneling and Underground Space Technology*, 17:83-97.
Patil et al. (2008) "Chemical and Microbial Characterization of North Slope Viscous Oils to Assess Viscosity Reduction and Enhanced Recovery," *United States Department of Energy National Energy Technology Laboratory*, 174 pages.
Sheehan, John; Dunahay, Terri; Benemann, John; and Roessler, Paul (Jul. 1998) "A Look Back at the U.S. Department of Energy's Aquatic Species Program: Biodiesel from Algae," *National Renewable Energy Laboratory*/TP-580-24190, 328 pages.
Sifferman et al. (2003) "Starch-Lubricant Compositions for Improved Lubricity and Fluid Loss in Water-Based Drilling Muds," *International Symposium on Oilfield Chemistry, Houston, Texas, Society of Petroleum Engineers*, [Abstract Only, 2 pages].
Simpson et al. (2007) "In Situ Biosurfactant Production by *Bacillus* Strains Injected into a Limestone Petroleum Reservoir," *Appl Environ Microbiol.* 73(4):1239-47.

* cited by examiner

MICROALGAL COMPOSITIONS AND USES THEREOF

CROSS-REFERENCE TO RELATED APPLICATIONS

This application claims the benefit under 35 USC 119(e) of U.S. Provisional Patent Application No. 62/137,784, filed Mar. 24, 2015, U.S. Provisional Patent Application No. 62/162,553, filed May 15, 2015, and U.S. Provisional Patent Application No. 62/175,014, filed Jun. 12, 2015, each of which is incorporated herein by reference in its entirety.

BACKGROUND

Solid or dry film lubricants function as friction reducers between moving surfaces. Common solid lubricants include molybdenum and tungsten disulfide, boron nitride, and graphite. A need exists for alternative and improved solid lubricants.

SUMMARY

The present disclosure provides microalgal compositions and methods for their use.

In one embodiment, provided is a lubricant comprising an oleaginous microbial biomass, wherein the oleaginous microbial biomass comprises intact cells containing at least 50% triglyceride oil.

In another embodiment, provided is a floor sweep composition comprising an oleaginous microbial biomass, wherein the oleaginous microbial biomass comprises intact cells containing at least 50% triglyceride oil.

In one embodiment, provided is a material suitable for use in 3D printing comprising an oleaginous microbial biomass. In some embodiments, provided is an object printed using a 3D printing material comprising an oleaginous microbial biomass. In some embodiments, the 3D printing material is in a powder form. Such a form can be readily used when a sintering process is being used to print an object. The material can also be in a filament form, such as that suitable for printing using fused deposition modeling (FDM). In some embodiments, the microalgal biomass comprises 1 to 85% by weight of the 3D printing material. In other embodiments, the microalgal biomass comprises at least 5%, 10%, 15%, 20%, or 25% by weight of the 3D printing material. In some embodiments, the 3D printing material comprises microalgal biomass and a thermoplastic. In some embodiments, the thermoplastic is Polylactic Acid (PLA) or Acrylonitrile Butadiene Styrene (ABS). In some embodiments of the 3D printing material, the microalgal biomass comprises intact cells.

In some embodiments, the lubricant is selected from the group consisting of a spray oil, food grade lubricant, a railroad lubricant, a gear lubricant, a bearing lubricant, crankcase lubricant, a cylinder lubricant, a compressor lubricant, a turbine lubricant, a chain lubricant, an oven chain lubricant, wire rope lubricant, a conveyor lubricant, a combustion engine lubricant, an electric motor lubricant, a total-loss lubricant, a textile lubricant, a heat transfer fluid, a release agent, a hydraulic fluid, a metal working fluid, and a grease.

In some embodiments, the lubricant comprises one or more of an anti-oxidant, a corrosion inhibitor, a metal deactivator, a binder, a chelating agent, a metal chelator, an oxygen scavenger, an anti-wear agent, an extreme pressure resistance additive, an anti-microbial agent, a biocide, a bacteriocide, a fungicide, a pH adjuster, an emulsifier, a lubricity agent, a vegetable oil, a petroleum derived oil, a high viscosity petroleum hydrocarbon oil, a petroleum derivative, a pour point depressant, a moisture scavenger, a defoamers, an anti-misting agent, an odorant, a surfactant, a humectant, a rheology modifier, or a colorant.

In some embodiments, the lubricant is a metal working fluid. In other embodiments, the metal working fluid is a cutting lubricant, a gun drilling lubricant, stamping lubricant, a metal forming lubricant, and a way lubricant. In still other embodiments, the lubricant comprises one or more of a napthenic oil, a paraffinc oil, a fatty acid ester, a high molecular weight ester, a glycol ester, an ethylene oxide copolymer, a polypropylene oxide copolymer, a naturally occurring triglyceride, graphite, graphite fluoride, molybdenum disulfide, tungsten disulfide, tin sulfide, boron nitride.

In some embodiments, the oleaginous biomass comprises at least 90%, 80%, 70%, 60%, or 50% intact cells.

In some embodiments, the intact cells comprise at least 60%, 65%, 70%, 80%, 85%, or 90% triglyceride oil.

In some embodiments, the lubricant or compositions provided herein further comprises lysed cells.

In some embodiments, the oleaginous microbial biomass is obtained from a microalgae.

In some embodiments, the microalgae is of the genus *Prototheca, Auxenochlorella, Chlorella*, or *Parachlorella*. In other embodiments, the microalgae is of the species *Prototheca moriformis*. In still other embodiments, the microalgae is of the species *Auxenochlorella protothecoides*.

In some embodiments, the triglyceride oil has fatty acid profile has at least 75%, 80%, or 85% C18:1.

In some embodiments, the oil has a fatty acid profile of greater than 85% C18:1 and less than 3% polyunsaturates.

In some embodiments, the oil has a fatty acid profile has less than 6%, 5%, 4%, 3%, 2%, 1%, 0.9%, 0.8%, 0.7%, 0.6%, 0.5%, 0.4%, 0.3%, 0.2%, 0.1%, 0.05%, or 0.01% polyunsaturated fatty acids.

In some embodiments, the oil has a fatty acid profile of greater than 15% C16:0 and greater than 55% 18:1.

In some embodiments, the oil has a fatty acid profile of greater than 50%, 60%, 70%, or 80% combined C10:0 and C12:0.

In some embodiments, the oil has a fatty acid profile of greater than 60% C10:0 and C12:0 and greater than 10% C14:0.

In some embodiments, the oil has a fatty acid profile of greater than 40%, 45%, or 50% C14:0.

In some embodiments, the oil has a fatty acid profile of at least 70% SOS and no more than 4% trisaturates.

In some embodiments, the oil has a fatty acid profile of greater than 50% C18:0 and greater than 30% C18:1.

In some embodiments, provided is a method for providing lubrication to a surface, the method comprising applying a lubricant disclosed herein to the surface.

In some embodiments, the surface is a metal. In other embodiments, the lubricant reduces metal on metal friction.

In some embodiments, the lubricant forms a film on the surface.

In some embodiments, the lubricant is an oil based lubricant. In some embodiments, the lubricant is water based lubricant. In some embodiments, the oil based lubricant contains 5-25% water.

In some embodiments, the lubricant comprises predominantly intact cells. In some embodiments, more than 50% of the cells are intact. In some embodiments, more than 75% of the cells are intact. In some embodiments, more than 90% of the cells are intact.

In some embodiments, the lubricant comprises predominantly lysed cells. In some embodiments, at least 75% of the cells by weight are lysed. In some embodiments, at least 85% of the cells by weight are lysed. In some embodiments, at least 90% of the cells by weight are lysed.

In some embodiments, the lubricant comprises delipidated cells. In some embodiments, at least 70% by weight of oil has been extracted. In some embodiments, at least 80% by weight of oil has been extracted. In some embodiments, at least 85% by weight of oil has been extracted. In some embodiments, at least 90% by weight of oil has been extracted from the cells.

In some embodiments, the delipidated cells are treated with acid and/or base. The acid and/or base treatment digests the cells.

In the various lubricants and/or methods discussed above and herein, solid particles in the lubricant can contribute to the lubricant's lubricity. In some cases, the solid particles have a particle size distribution d50 value of from 100 to 500 μm, wherein the d50 value is the median diameter of particle size distribution at 50% of the distribution, where 50% of the particles are above the d50 value and 50% are below the d50 value. For example, for a sample with a particle size distribution of d50 of 100 μm, 50% of the particles are greater than 100 μm and 50% of the particles are less than 100 μm. In some embodiments, the d50 value is from 200 to 400 μm. In some embodiments, the d50 value is from 300 to 400 μm. For a sample with a particle size distribution of d10 of 100 μm, 90% of the particles are greater than 100 μm and 10% of the particles are less than 100 μm. Similarly, for a sample with a particle size distribution of d90 of 100 μm, 10% of the particles are greater than 100 μm and 90% of the particles are less than 100 μm.

In some embodiments, provided is a water based lubricant comprising predominantly intact cells. In some such embodiments, the lubricant has a particle size distribution d50 value of from 5 to 30 μm. In some such embodiments, the lubricant has a particle size distribution d50 value of from 7 to 12 μm.

In some embodiments, provided is an oil based lubricant comprising predominantly intact cells. In some such embodiments, the lubricant has a particle size distribution d50 value of from 100 to 500 μm. In some such embodiments, the lubricant has a particle size distribution d50 value of from 100 to 250 μm.

In some embodiments, provided is a water based lubricant comprising predominantly lysed cells. In some such embodiments, the lubricant has a particle size distribution d50 value of from 0.5 to 15 μm. In some such embodiments, the lubricant has a particle size distribution d50 value of from 6 to 12 μm.

In some embodiments, provided is an oil based lubricant comprising predominantly lysed cells. In some such embodiments, the lubricant has a particle size distribution d50 value of from 5 to 20 μm. In some such embodiments, the lubricant has a particle size distribution d50 value of from 8 to 14 μm.

In some embodiments, provided is a water based lubricant comprising delipidated cells. In some such embodiments, the lubricant has a particle size distribution d50 value of from 0.5 to 20 μm. In some such embodiments, the lubricant has a particle size distribution d50 value of from 5 to 15 μm.

In some embodiments, provided is an oil based lubricant comprising delipidated cells. In some such embodiments, the lubricant has a particle size distribution d50 value of from 0.5 to 200 μm. In some such embodiments, the lubricant has a particle size distribution d50 value of from 10 to 100 μm.

In the various lubricants and/or methods discussed above and herein, the lubricant can have a decreased health risk (e.g. health risk due to inhalation) compared to traditional solid film lubricants such as those containing graphite (typical d50 value of 1-10 μm) and/or molybdenum disulfide ($MoS_2$, typical d50 value of 0.9-30 μm).

In the various lubricants and/or methods discussed above and herein, the lubricant can be more easily removed from a surface (e.g. workpiece or human skin) in contact with the lubricant after use compared to traditional solid film lubricants such as those containing graphite and/or molybdenum disulfide which leave difficult to remove residues.

DETAILED DESCRIPTION

Definitions

An "oleaginous" cell is a cell capable of producing at least 20% lipid by dry cell weight, naturally or through recombinant or classical strain improvement. An "oleaginous microbe" or "oleaginous microorganism" is a unicellular microbe, including a microalga that is oleaginous. An oleaginous cell also encompasses a cell that has had some or all of its lipid or other content removed, and both live and dead cells. An "oleaginous microbial biomass" may contain cells and/or intracellular contents as well as extracellular material. Extracellular material includes, but is not limited to, compounds secreted by a cell.

"Microalgae" refers to eukaryotic microbial organisms that contain a chloroplast or other plastid, and optionally that are capable of performing photosynthesis, or a prokaryotic microbial organism capable of performing photosynthesis. Microalgae include obligate photoautotrophs, which cannot metabolize a fixed carbon source as energy, as well as heterotrophs, which can live solely off of a fixed carbon source. Microalgae include unicellular organisms that separate from sister cells shortly after cell division, such as *Chlamydomonas*, as well as microbes such as, for example, *Volvox*, which is a simple multicellular photosynthetic microbe of two distinct cell types. Microalgae include cells such as *Chlorella, Dunaliella*, and *Prototheca*. Microalgae also include other microbial photosynthetic organisms that exhibit cell-cell adhesion, such as *Agmenellum, Anabaena*, and *Pyrobotrys*. Microalgae also include obligate heterotrophic microorganisms that have lost the ability to perform photosynthesis. Examples of obligate heterotrophs include certain dinoflagellate algae species and species of the genus *Prototheca*. Microalgae include those belonging to the phylum Chlorophyta and in the class Trebouxiophyceae. Within this class are included microalgae belonging to the order Chlorellales, optionally the family Chlorellaceae, and optionally the genus *Prototheca, Auxenochlorella, Chlorella*, or *Parachlorella.*

"Microalgal extracts" refer to any cellular components that are extracted from the cell or are secreted by the cells. The extracts include those can be obtained by mechanical pressing of the cells or by solvent extraction. Cellular components can include, but are not limited to, microalgal oil, proteins, carbohydrates, phospholipids, polysaccharides, macromolecules, minerals, cell wall, trace elements, carotenoids, and sterols. In some cases the extract is a polysaccharide that is secreted from a cell into the extracellular environment and has lost any physical association with the cells. In other cases the polysaccharide remain associated with the cell wall. Polysaccharides are typically polymers of monosaccharide units and have high molecular weights, usually with an average of 2 million Daltons or greater, although fragments can be smaller in size.

"Microalgal oils" or "cell oils" refer to lipid components produced by microalgal cells such as triglycerides.

"Modified microalgal extracts" refer to extracts that are chemically or enzymatically modified. For example, triglyceride extracts can be converted to fatty acid alkyl esters (e.g. fatty acid methyl esters) by transesterification.

"Microalgal biomass," "algal biomass" or "biomass" refers to material produced by growth and/or propagation of microalgal cells. Biomass may contain cells and/or intracellular contents as well as extracellular material. Extracellular material includes, but is not limited to, compounds secreted by a cell.

"Floor sweep ingredient" refers to an ingredient conventionally used in floor sweep compositions that is not physically or chemically incompatible with the microalgal components described herein. "Floor sweep ingredients" include, without limitation, absorbents, abrasives, binders, vegetable oils, petroleum derived oils, petroleum derivatives, antimicrobial agents, bulking agents, and chemical additives. Such "floor sweep ingredients" are known in the art.

"Metalworking" refers to cutting, grinding, punching, or forming of metal. Metal forming includes any process that is designed to alter the shape of metal while minimizing production of small metal fragments (chips). These processes include but are not limited to forging; extrusion; rod, wire or tube drawing; rolling; and sheet forming Examples of forging are such operations as open-die forging, cogging, closed die forging, coining, nosing, upsetting, heading, piercing, hobbing, roll forging, orbital forging, ring rolling, rotary swaging of bars and tubes, and radial forging. Examples of rolling are flat rolling or shape rolling. Examples of sheet forming are blanking, piercing, press bending, deep drawing, stamping, stretch forming, spinning, hydroforming, rubber-pad forming, shallow recessing, explosive forming, dimpling, roll forming, or flanging.

"Metalworking fluid ingredient" refers to an ingredient conventionally used in metalworking fluid compositions that is not physically or chemically incompatible with the microalgal components described herein. "Metalworking fluid ingredients" include, without limitation, antifoaming agents, antimicrobial agents, binders, biocides, bacteriocides, fungicides, buffering agents, chemical additives, pH adjusters, emulsifiers, lubricity agents, vegetable oils, petroleum derived oils, petroleum derivatives, corrosion inhibitors, extreme pressure additives, defoamers, alkaline reserves, antimisting agents, couplers, odorants, surfactants, humectants, thickeners, chelating agents, and dyes. Such "metalworking fluid ingredients" are known in the art.

"Dry weight" or "dry cell weight" refer to weight as determined in the relative absence of water. For example, reference to a component of microalgal biomass as comprising a specified percentage by dry weight means that the percentage is calculated based on the weight of the biomass after all or substantially all water has been removed.

"Exogenous gene" refers to a nucleic acid transformed into a cell. A transformed cell may be referred to as a recombinant cell, into which additional exogenous gene(s) may be introduced. The exogenous gene may be from a different species (and so heterologous), or from the same species (and so homologous) relative to the cell being transformed. In the case of a homologous gene, it occupies a different location in the genome of the cell relative to the endogenous copy of the gene. The exogenous gene may be present in more than one copy in the cell. The exogenous gene may be maintained in a cell as an insertion into the genome or as an episomal molecule.

"Exogenously provided" describes a molecule provided to the culture media of a cell culture.

"Fixed carbon source" means molecule(s) containing carbon, preferably organic, that are present at ambient temperature and pressure in solid or liquid form.

"Fatty acid profile" refers to the distribution of different carbon chain lengths and saturation levels of fatty acid moieties in a particular sample of biomass or oil. "Triglycerides" are lipids where three fatty acid moieties are attached to a glycerol moiety. A sample could contain lipids in which approximately 60% of the fatty acid moieties is C18:1, 20% is C18:0, 15% is C16:0, and 5% is C14:0. In cases in which a carbon length is referenced generically, such as "C18", such reference can include any amount of saturation; for example, microalgal biomass that contains 20% lipid as C18 can include C18:0, C18:1, C18:2, and the like, in equal or varying amounts, the sum of which constitute 20% of the biomass.

"Lipids" are a class of molecules that are soluble in nonpolar solvents (such as ether and hexane) and are relatively or completely insoluble in water. Lipid molecules have these properties because they consist largely of long hydrocarbon tails which are hydrophobic in nature. Examples of lipids include fatty acids (saturated and unsaturated); glycerides or glycerolipids (such as monoglycerides, diglycerides, triglycerides or neutral fats, and phosphoglycerides or glycerophospholipids); nonglycerides (sphingolipids, tocopherols, tocotrienols, sterol lipids including cholesterol and steroid hormones, prenol lipids including terpenoids, fatty alcohols, waxes, and polyketides); and complex lipid derivatives (sugar-linked lipids, or glycolipids, and protein-linked lipids).

"Homogenate" means biomass that has been physically disrupted.

"Homogenize" means to blend two or more substances into a homogenous or uniform mixture. In some embodiments, a homogenate is created. In other embodiments, the biomass is predominantly intact, but homogeneously distributed throughout the mixture.

"Predominantly intact cells" refers to a population of cells which comprise more than 50%, 75%, or 90% intact cells. "Intact" refers to the physical continuity of the cellular membrane enclosing the intracellular components of the cell and means that the cellular membrane has not been disrupted in any manner that would release the intracellular components of the cell to an extent that exceeds the permeability of the cellular membrane under conventional culture conditions or those culture conditions described herein.

"Predominantly lysed cells" refers to a population of cells which comprise at least 75%, 55%, or 90% lysed cells.

"Delipidated cells" refers to a population of cells where oil has been extracted from the cells, such that the extracted oil is not in physical contact with the cells. In some embodiments, 50% to 95% by weight of oil has been extracted from the cells. In some embodiments, 5% to 30% by weight of oil remains in the delipidated cells. In some embodiments, 10% to 15% by weight of oil remains in the delipidated cells.

Reference to proportions by volume, i.e., "v/v," means the ratio of the volume of one substance or composition to the volume of a second substance or composition. For example, reference to a composition that comprises 5% v/v microalgal oil and at least one other ingredient means that 5% of the composition's volume is composed of microalgal oil; e.g., a composition having a volume of 100 $mm^3$ would contain 5 $mm^3$ of microalgal oil and 95 $mm^3$ of other constituents.

Reference to proportions by weight, i.e., "w/w," means the ratio of the weight of one substance or composition to the weight of a second substance or composition. For example, reference to a composition that comprises 5% w/w microalgal biomass and at least one other ingredient means that 5% of the composition is composed of microalgal biomass; e.g., a 100 g composition would contain 5 g of microalgal biomass and 95 g of other constituents.

Microalgal Cells and Extracts

The microalgal cells can be prepared and heterotrophically cultured according to methods such as those described in WO2008/151149, WO2010/063031, WO2010/045368, WO2010/063032, WO2011/150411, WO2013/158938, 61/923,327 filed Jan. 3, 2014, PCT/US2014/037898 filed May 13, 2014, and in U.S. Pat. No. 8,557,249. The microalgal cells can be wild type cells or can be modified by genetic engineering and/or classical mutagenesis to alter their fatty acid profile and/or lipid productivity or other physical properties such as color.

In some embodiments, the cell wall of the microalgae must be disrupted during the use of the industrial product in order to release the active components. Hence, in some embodiments having strains of microalgae with cell walls susceptible to disruption are preferred.

In particular embodiments, the wild-type or genetically engineered microalgae comprise cells that are at least 10%, at least 15%, at least 20%, at least 25%, at least 30%, at least 35%, at least 40%, at least 45%, at least 50%, at least 55%, at least 60%, at least 65%, at least 70%, at least 75%, or at least 80% or more oil by dry weight. Preferred organisms grow heterotrophically (on sugars in the absence of light).

In some embodiments, the microalgae is from the genus *Chlorella*. *Chlorella* is a genus of single-celled green algae, belonging to the phylum Chlorophyta. *Chlorella* cells are generally spherical in shape, about 2 to 10 μm in diameter, and lack flagella. Some species of *Chlorella* are naturally heterotrophic. In some embodiments, the microalgae is *Chlorella* (*auexnochlorella*) *protothecoides, Chlorella ellipsoidea, Chlorella minutissima, Chlorella zofinienesi, Chlorella luteoviridis, Chlorella kessleri, Chlorella sorokiniana, Chlorella fusca* var. *vacuolata Chlorella* sp., *Chlorella* cf. *minutissima* or *Chlorella emersonii*. Other species of *Chlorella* those selected from the group consisting of *anitrata, Antarctica, aureoviridis, candida*, capsulate, desiccate, *ellipsoidea* (including strain CCAP 211/42), *emersonii, fusca* (including var. *vacuolata*), *glucotropha, infusionum* (including var. *actophila* and var. *auxenophila*), *kessleri* (including any of UTEX strains 397, 2229, 398), *lobophora* (including strain SAG 37.88), *luteoviridis* (including strain SAG 2203 and var. *aureoviridis* and *lutescens*), *miniata*, cf. *minutissima, minutissima* (including UTEX strain 2341), *mutabilis, nocturna, ovalis, parva, photophila, pringsheimii, protothecoides* (including any of UTEX strains 1806, 411, 264, 256, 255, 250, 249, 31, 29, 25 or CCAP 211/8D, or CCAP 211/17 and var. *acidicola*), *regularis* (including var. *minima*, and *umbricata*), *reisiglii* (including strain CCP 11/8), *saccharophila* (including strain CCAP 211/31, CCAP 211/32 and var. *ellipsoidea*), *salina, simplex, sorokiniana* (including strain SAG 211.40B), sp. (including UTEX strain 2068 and CCAP 211/92), *sphaerica, stigmatophora, trebouxioides, vanniellii, vulgaris* (including strains CCAP 211/11K, CCAP 211/80 and *f. tertia* and var. *autotrophica, viridis, vulgaris, vulgaris f. tertia, vulgaris f. viridis*), *xanthella*, and *zofingiensis*.

In addition to *Chlorella*, other genera of microalgae can also be used in the methods and compositions provided herein. In some embodiments, the microalgae is a species selected from the group consisting *Parachlorella kessleri, Parachlorella beijerinckii, Neochloris oleabundans, Bracteacoccus*, including *B. grandis, B. cinnabarinas*, and *B. aerius, Bracteococcus* sp. or *Scenedesmus rebescens*. Other nonlimiting examples of microalgae species include those species from the group of species and genera consisting of *Achnanthes orientalis; Agmenellum; Amphiprora hyaline; Amphora*, including *A. coffeiformis* including *A.c. linea, A.c. punctata, A.c. taylori, A.c. tenuis, A.c. delicatissima, A.c. delicatissima capitata; Anabaena; Ankistrodesmus*, including *A. falcatus; Boekelovia hooglandii; Borodinella; Botryococcus braunii*, including *B. sudeticus; Bracteococcus*, including *B. aerius, B. grandis, B. cinnabarinas, B. minor*, and *B. medionucleatus; Carteria; Chaetoceros*, including *C. gracilis, C. muelleri*, and *C. muelleri subsalsum; Chlorococcum*, including *C. infusionum; Chlorogonium; Chroomonas; Chrysosphaera; Cricosphaera; Crypthecodinium cohnii; Cryptomonas; Cyclotella*, including *C. cryptica* and *C. meneghiniana; Dunaliella*, including *D. bardawil, D. bioculata, D. granulate, D. maritime, D. minuta, D. parva, D. peircei, D. primolecta, D. salina, D. terricola, D. tertiolecta*, and *D. viridis; Eremosphaera*, including *E. viridis; Ellipsoidon; Euglena; Franceia; Fragilaria*, including *F. crotonensis; Gleocapsa; Gloeothamnion; Hymenomonas; Isochrysis*, including *I. aff. galbana* and *I. galbana; Lepocinclis; Micractinium* (including UTEX LB 2614); *Monoraphidium*, including *M. minutum; Monoraphidium; Nannochloris; Nannochloropsis*, including *N. salina; Navicula*, including *N. acceptata, N. biskanterae, N. pseudotenelloides, N. pelliculosa*, and *N. saprophila; Neochloris oleabundans; Nephrochloris; Nephroselmis; Nitschia communis; Nitzschia*, including *N. alexandrina, N. communis, N. dissipata, N. frustulum, N. hantzschiana, N. inconspicua, N. intermedia, N. microcephala, N. pusilla, N. pusilla elliptica, N. pusilla monoensis*, and *N. quadrangular; Ochromonas; Oocystis*, including *O. parva* and *O. pusilla; Oscillatoria*, including *O. limnetica* and *O. subbrevis; Parachlorella, including P. beijerinckii* (including strain SAG 2046) and *P. kessleri* (including any of SAG strains 11.80, 14.82, 21.11H9); *Pascheria*, including *P. acidophila; Pavlova; Phagus; Phormidium; Platymonas; Pleurochrysis*, including *P. carterae* and *P. dentate; Prototheca*, including *P. stagnora* (including UTEX 327), *P. portoricensis*, and *P. moriformis* (including UTEX strains 1441, 1435, 1436, 1437, 1439); *Pseudochlorella aquatica; Pyramimonas; Pyrobotrys; Rhodococcus opacus; Sarcinoid chrysophyte; Scenedesmus*, including *S. armatus* and *S. rubescens; Schizochytrium; Spirogyra; Spirulina platensis; Stichococcus; Synechococcus; Tetraedron; Tetraselmis*, including *T. suecica; Thalassiosira weissflogii*; and *Viridiella fridericiana*.

Media and Culture Conditions for Microalgae

Microalgae are cultured in liquid media to propagate biomass. Microalgal species are grown in a medium containing a fixed carbon and/or fixed nitrogen source in the absence of light. Such growth is known as heterotrophic growth. For some species of microalgae, for example, heterotrophic growth for extended periods of time such as 10 to 15 or more days under limited nitrogen conditions results accumulation of high lipid content in cells.

Microalgal culture media typically contains components such as a fixed carbon source (discussed below), a fixed nitrogen source (such as protein, soybean meal, yeast extract, cornsteep liquor, ammonia (pure or in salt form), nitrate, or nitrate salt), trace elements (for example, zinc, boron, cobalt, copper, manganese, and molybdenum in, e.g., the respective forms of $ZnCl_2$, $H_3BO_3$, $CoCl_2.6H_2O$, $CuCl_2.2H_2O$, $MnCl_2.4H_2O$ and $(NH_4)_6Mo_7O_{24}.4H_2O$), optionally a buffer for pH maintenance, and phosphate (a source of phosphorous; other phosphate salts can be used). Other components include salts such as sodium chloride, particularly for seawater microalgae.

In a particular example, a medium suitable for culturing *Chlorella protothecoides* comprises Proteose Medium. This medium is suitable for axenic cultures, and a 1 L volume of the medium (pH ~6.8) can be prepared by addition of 1 g of proteose peptone to 1 liter of Bristol Medium. Bristol medium comprises 2.94 mM $NaNO_3$, 0.17 mM $CaCl_2.2H_2O$, 0.3 mM $MgSO_4.7H_2O$, 0.43 mM, 1.29 mM $KH_2PO_4$, and 1.43 mM NaCl in an aqueous solution. For 1.5% agar medium, 15 g of agar can be added to 1 L of the solution. The solution is covered and autoclaved, and then stored at a refrigerated temperature prior to use. Other methods for the growth and propagation of *Chlorella protothecoides* to high oil levels as a percentage of dry weight have been described (see for example Miao and Wu, *J. Biotechnology,* 2004, 11:85-93 and Miao and Wu, *Biosource Technology* (2006) 97:841-846 (demonstrating fermentation methods for obtaining 55% oil dry cell weight)). High oil algae can typically be generated by increasing the length of a fermentation while providing an excess of carbon source under nitrogen limitation.

Solid and liquid growth media are generally available from a wide variety of sources, and instructions for the preparation of particular media that is suitable for a wide variety of strains of microorganisms can be found, for example, online at a site maintained by the University of Texas at Austin for its culture collection of algae (UTEX). For example, various fresh water media include ½, ⅓, ⅕, 1×, ⅔, 2×CHEV Diatom Medium; 1:1 DYIII/PEA+Gr+; Ag Diatom Medium; Allen Medium; BG11-1 Medium; Bold 1NV and 3N Medium; *Botryococcus* Medium; Bristol Medium; Chu's Medium; CR1, CR1-S, and CR1+ Diatom Medium; *Cyanidium* Medium; Cyanophycean Medium; Desmid Medium; DYIII Medium; *Euglena* Medium; HEPES Medium; J Medium; Malt Medium; MES Medium; Modified Bold 3N Medium; Modified COMBO Medium; N/20 Medium; Ochromonas Medium; P49 Medium; *Polytomella* Medium; Proteose Medium; Snow Algae Media; Soil Extract Medium; Soilwater: BAR, GR−, GR−/NH4, GR+, GR+/NH4, PEA, Peat, and VT Medium; *Spirulina* Medium; Tap Medium; *Trebouxia* Medium; Volvocacean Medium; Volvocacean-3N Medium; *Volvox* Medium; *Volvox*-Dextrose Medium; Waris Medium; and Waris+Soil Extract Medium. Various Salt Water Media include: 1%, 5%, and 1×F/2 Medium; ½, 1×, and 2× Erdschreiber's Medium; ½, ⅓, ¼, ⅕, 1×, 5/3, and 2× Soil+Seawater Medium; ¼ ERD; 2/3 Enriched Seawater Medium; 20% Allen+80% ERD; Artificial Seawater Medium; BG11-1+0.36% NaCl Medium; BG11-1+1% NaCl Medium; Bold 1NV:Erdshreiber (1:1) and (4:1); Bristol-NaCl Medium; Dasycladales Seawater Medium; ½ and 1× Enriched Seawater Medium, including ES/10, ES/2, and ES/4; F/2+NH4; LDM Medium; Modified 1× and 2×CHEV; Modified 2×CHEV+ Soil; Modified Artificial Seawater Medium; *Porphridium* Medium; and SS Diatom Medium.

Other suitable media for use with the methods provided herein can be readily identified by consulting other organizations that maintain cultures of microorganisms, such as SAG, CCAP, or CCALA. SAG refers to the Culture Collection of Algae at the University of Göttingen (Göttingen, Germany), CCAP refers to the culture collection of algae and protozoa managed by the Scottish Association for Marine Science (Scotland, United Kingdom), and CCALA refers to the culture collection of algal laboratory at the Institute of Botany (Třeboň, Czech Republic).

Microorganisms useful in accordance with the methods of the present disclosure are found in various locations and environments throughout the world. As a consequence of their isolation from other species and their resulting evolutionary divergence, the particular growth medium for optimal growth and generation of oil and/or lipid and/or protein from any particular species of microbe can be difficult or impossible to predict, but those of skill in the art can readily find appropriate media by routine testing in view of the disclosure herein. In some cases, certain strains of microorganisms may be unable to grow on a particular growth medium because of the presence of some inhibitory component or the absence of some essential nutritional requirement required by the particular strain of microorganism. The examples below provide exemplary methods of culturing various species of microalgae to accumulate high levels of lipid as a percentage of dry cell weight.

Suitable fixed carbon sources for use in the medium, include, for example, glucose, fructose, sucrose, galactose, xylose, mannose, rhamnose, arabinose, N-acetylglucosamine, glycerol, floridoside, glucuronic acid, and/or acetate.

Process conditions can be adjusted to increase the percentage weight of cells that is lipid. For example, in certain embodiments, a microalgae is cultured in the presence of a limiting concentration of one or more nutrients, such as, for example, nitrogen, phosphorous, or sulfur, while providing an excess of a fixed carbon source, such as glucose. Nitrogen limitation tends to increase microbial lipid yield over microbial lipid yield in a culture in which nitrogen is provided in excess. In particular embodiments, the increase in lipid yield is at least about 10%, 50%, 100%, 200%, or 500%. The microbe can be cultured in the presence of a limiting amount of a nutrient for a portion of the total culture period or for the entire period. In some embodiments, the nutrient concentration is cycled between a limiting concentration and a non-limiting concentration at least twice during the total culture period.

In a steady growth state, the cells accumulate oil but do not undergo cell division. In one embodiment, the growth state is maintained by continuing to provide all components of the original growth media to the cells with the exception of a fixed nitrogen source. Cultivating microalgal cells by feeding all nutrients originally provided to the cells except a fixed nitrogen source, such as through feeding the cells for an extended period of time, results in a higher percentage of lipid by dry cell weight.

In other embodiments, high lipid biomass is generated by feeding a fixed carbon source to the cells after all fixed nitrogen has been consumed for extended periods of time, such as at least one or two weeks. In some embodiments, cells are allowed to accumulate oil in the presence of a fixed carbon source and in the absence of a fixed nitrogen source for over 20 days. Microalgae grown using conditions described herein or otherwise known in the art can comprise at least about 20% lipid by dry weight, and often comprise 35%, 45%, 55%, 65%, and even 75% or more lipid by dry weight. Percentage of dry cell weight as lipid in microbial lipid production can therefore be improved by holding cells in a heterotrophic growth state in which they consume carbon and accumulate oil but do not undergo cell division.

Organic nitrogen sources have been used in microbial cultures since the early 1900s. The use of organic nitrogen sources, such as corn steep liquor was popularized with the production of penicillin from mold. Researchers found that the inclusion of corn steep liquor in the culture medium increased the growth of the microorganism and resulted in an increased yield in products (such as penicillin). An analysis of corn steep liquor determined that it was a rich source of nitrogen and also vitamins such as B-complex vitamins, riboflavin panthothenic acid, niacin, inositol and nutrient minerals such as calcium, iron, magnesium, phosphorus and potassium (Ligget and Koffler, *Bacteriological Reviews* (1948); 12(4): 297-311). Organic nitrogen sources, such as corn steep liquor, have been used in fermentation media for yeasts, bacteria, fungi and other microorganisms. Non-limiting examples of organic nitrogen sources are yeast extract, peptone, corn steep liquor and corn steep powder. Non-limiting examples of preferred inorganic nitrogen sources include, for example, and without limitation, $(NH_4)_2SO_4$ and $NH_4OH$. In one embodiment, the culture media for contains only inorganic nitrogen sources. In another embodiment, the culture media contains only organic nitrogen sources. In yet another embodiment, the culture media contains a mixture of organic and inorganic nitrogen sources.

In some embodiments, a bioreactor or fermentor is used to culture microalgal cells through the various phases of their physiological cycle. As an example, an inoculum of lipid-producing microalgal cells is introduced into the medium; there is a lag period (lag phase) before the cells begin to propagate. Following the lag period, the propagation rate increases steadily and enters the log, or exponential, phase. The exponential phase is in turn followed by a slowing of propagation due to decreases in nutrients such as nitrogen, increases in toxic substances, and quorum sensing mechanisms. After this slowing, propagation stops, and the cells enter a stationary phase or steady growth state, depending on the particular environment provided to the cells. For obtaining protein rich biomass, the culture is typically harvested during or shortly after then end of the exponential phase. For obtaining lipid rich biomass, the culture is typically harvested well after then end of the exponential phase, which may be terminated early by allowing nitrogen or another key nutrient (other than carbon) to become depleted, forcing the cells to convert the carbon sources, present in excess, to lipid. Culture condition parameters can be manipulated to optimize total oil production, the combination of lipid species produced, and/or production of a specific oil.

Bioreactors offer many advantages for use in heterotrophic growth and propagation methods. As will be appreciated, provisions made to make light available to the cells in photosynthetic growth methods are unnecessary when using a fixed-carbon source in the heterotrophic growth and propagation methods described herein. To produce biomass for use in industrial products, microalgae are preferably fermented in large quantities in liquid, such as in suspension cultures as an example. Bioreactors such as steel fermentors (5000 liter, 10,000 liter, 40,000 liter, and higher) can accommodate very large culture volumes. Bioreactors also typically allow for the control of culture conditions such as temperature, pH, oxygen tension, and carbon dioxide levels. For example, bioreactors are typically configurable, for example, using ports attached to tubing, to allow gaseous components, like oxygen or nitrogen, to be bubbled through a liquid culture.

Bioreactors can be configured to flow culture media though the bioreactor throughout the time period during which the microalgae reproduce and increase in number. In some embodiments, for example, media can be infused into the bioreactor after inoculation but before the cells reach a desired density. In other instances, a bioreactor is filled with culture media at the beginning of a culture, and no more culture media is infused after the culture is inoculated. In other words, the microalgal biomass is cultured in an aqueous medium for a period of time during which the microalgae reproduce and increase in number; however, quantities of aqueous culture medium are not flowed through the bioreactor throughout the time period. Thus in some embodiments, aqueous culture medium is not flowed through the bioreactor after inoculation.

Bioreactors equipped with devices such as spinning blades and impellers, rocking mechanisms, stir bars, means for pressurized gas infusion can be used to subject microalgal cultures to mixing. Mixing may be continuous or intermittent. For example, in some embodiments, a turbulent flow regime of gas entry and media entry is not maintained for reproduction of microalgae until a desired increase in number of said microalgae has been achieved.

As briefly mentioned above, bioreactors are often equipped with various ports that, for example, allow the gas content of the culture of microalgae to be manipulated. To illustrate, part of the volume of a bioreactor can be gas rather than liquid, and the gas inlets of the bioreactor to allow pumping of gases into the bioreactor. Gases that can be beneficially pumped into a bioreactor include air, air/$CO_2$ mixtures, noble gases, such as argon, and other gases. Bioreactors are typically equipped to enable the user to control the rate of entry of a gas into the bioreactor. As noted above, increasing gas flow into a bioreactor can be used to increase mixing of the culture.

Increased gas flow affects the turbidity of the culture as well. Turbulence can be achieved by placing a gas entry port below the level of the aqueous culture media so that gas entering the bioreactor bubbles to the surface of the culture. One or more gas exit ports allow gas to escape, thereby preventing pressure buildup in the bioreactor. Preferably a gas exit port leads to a "one-way" valve that prevents contaminating microorganisms from entering the bioreactor.

The specific examples of bioreactors, culture conditions, and heterotrophic growth and propagation methods described herein can be combined in any suitable manner to improve efficiencies of microbial growth and lipid and/or protein production.

Concentration of Microalgae after Fermentation

Microalgal cultures generated according to the methods described above yield microalgal biomass in fermentation media. To prepare the biomass for use as a industrial product composition, the biomass is concentrated, or harvested, from the fermentation medium. At the point of harvesting the microalgal biomass from the fermentation medium, the biomass comprises predominantly intact cells suspended in an aqueous culture medium. To concentrate the biomass, a dewatering step is performed. Dewatering or concentrating refers to the separation of the biomass from fermentation broth or other liquid medium and so is solid-liquid separation. Thus, during dewatering, the culture medium is removed from the biomass (for example, by draining the fermentation broth through a filter that retains the biomass), or the biomass is otherwise removed from the culture medium. Common processes for dewatering include centrifugation, filtration, and the use of mechanical pressure. These processes can be used individually or in any combination.

Centrifugation involves the use of centrifugal force to separate mixtures. During centrifugation, the more dense components of the mixture migrate away from the axis of the centrifuge, while the less dense components of the mixture migrate towards the axis. By increasing the effective gravitational force (i.e., by increasing the centrifugation speed), more dense material, such as solids, separate from the less dense material, such as liquids, and so separate out according to density. Centrifugation of biomass and broth or other aqueous solution forms a concentrated paste comprising the microalgal cells. Centrifugation does not remove significant amounts of intracellular water. In fact, after centrifugation, there may still be a substantial amount of surface or free moisture in the biomass (e.g., upwards of 70%), so centrifugation is not considered to be a drying step.

Filtration can also be used for dewatering. One example of filtration that is suitable is tangential flow filtration (TFF), also known as cross-flow filtration. Tangential flow filtration is a separation technique that uses membrane systems and flow force to separate solids from liquids. For an illustrative suitable filtration method, see Geresh, Carb. Polym. 50; 183-189 (2002), which describes the use of a MaxCell A/G Technologies 0.45 uM hollow fiber filter. Also see, for example, Millipore Pellicon® devices, used with 100 kD, 300 kD, 1000 kD (catalog number P2C01MC01), 0.1 uM (catalog number P2VVPPV01), 0.22 uM (catalog number P2GVPPV01), and 0.45 uM membranes (catalog number P2HVMPV01). The retentate preferably does not pass through the filter at a significant level, and the product in the retentate preferably does not adhere to the filter material. TFF can also be performed using hollow fiber filtration systems. Filters with a pore size of at least about 0.1 micrometer, for example about 0.12, 0.14, 0.16, 0.18, 0.2, 0.22, 0.45, or at least about 0.65 micrometers, are suitable. Preferred pore sizes of TFF allow solutes and debris in the fermentation broth to flow through, but not microbial cells.

Dewatering can also be affected with mechanical pressure directly applied to the biomass to separate the liquid fermentation broth from the microbial biomass sufficient to dewater the biomass but not to cause predominant lysis of cells. Mechanical pressure to dewater microbial biomass can be applied using, for example, a belt filter press. A belt filter press is a dewatering device that applies mechanical pressure to a slurry (e.g., microbial biomass taken directly from the fermentor or bioreactor) that is passed between the two tensioned belts through a serpentine of decreasing diameter rolls. The belt filter press can actually be divided into three zones: the gravity zone, where free draining water/liquid is drained by gravity through a porous belt; a wedge zone, where the solids are prepared for pressure application; and a pressure zone, where adjustable pressure is applied to the gravity drained solids.

After concentration, microalgal biomass can be processed, as described herein below, to produce vacuum-packed cake, algal flakes, algal homogenate, algal powder, algal flour, or algal oil.

Chemical Composition of Microalgal Biomass

The microalgal biomass generated by the culture methods described herein comprises microalgal oil and/or protein as well as other constituents generated by the microorganisms or incorporated by the microorganisms from the culture medium during fermentation.

Microalgal biomass with a high percentage of oil/lipid accumulation by dry weight has been generated using different methods of culture, including methods known in the art. Microalgal biomass with a higher percentage of accumulated oil/lipid is useful in accordance with the present disclosure. *Chlorella vulgaris* cultures with up to 56.6% lipid by dry cell weight (DCW) in stationary cultures grown under autotrophic conditions using high iron (Fe) concentrations have been described (Li et al., *Bioresource Technology* 99(11):4717-22 (2008). *Nanochloropsis* sp. and *Chaetoceros calcitrans* cultures with 60% lipid by DCW and 39.8% lipid by DCW, respectively, grown in a photobioreactor under nitrogen starvation conditions have also been described (Rodolfi et al., *Biotechnology & Bioengineering* (2008)). *Parietochloris incise* cultures with approximately 30% lipid by DCW when grown phototropically and under low nitrogen conditions have been described (Solovchenko et al., *Journal of Applied Phycology* 20:245-251 (2008). *Chlorella protothecoides* can produce up to 55% lipid by DCW when grown under certain heterotrophic conditions with nitrogen starvation (Miao and Wu, *Bioresource Technology* 97:841-846 (2006)). Other *Chlorella* species, including *Chlorella emersonii, Chlorella sorokiniana* and *Chlorella minutissima* have been described to have accumulated up to 63% oil by DCW when grown in stirred tank bioreactors under low-nitrogen media conditions (Illman et al., *Enzyme and Microbial Technology* 27:631-635 (2000). Still higher percent lipid by DCW has been reported, including 70% lipid in *Dumaliella tertiolecta* cultures grown in increased NaCl conditions (Takagi et al., *Journal of Bioscience and Bioengineering* 101(3): 223-226 (2006)) and 75% lipid in *Botryococcus braunii* cultures (Banerjee et al., *Critical Reviews in Biotechnology* 22(3): 245-279 (2002)).

Heterotrophic growth results in relatively low chlorophyll content (as compared to phototrophic systems such as open ponds or closed photobioreactor systems). The reduced chlorophyll content found in heterotrophically grown microalgae (e.g., *Chlorella*) also reduces the green color in the biomass as compared to phototrophically grown microalgae.

Oil rich microalgal biomass generated by the culture methods described herein and useful in accordance with the present disclosure comprises at least 10% microalgal oil by DCW (dry cell weight). In some embodiments, the microalgal biomass comprises at least 15%, 25%, 50%, 75% or at least 90% microalgal oil by DCW.

The microalgal oil of the biomass described herein (or extracted from the biomass) can comprise glycerolipids with one or more distinct fatty acid ester side chains. Glycerolipids are comprised of a glycerol molecule esterified to one, two, or three fatty acid molecules, which can be of varying lengths and have varying degrees of saturation. Specific blends of algal oil can be prepared either within a single species of algae, or by mixing together the biomass (or algal oil) from two or more species of microalgae.

Thus, the oil composition, i.e., the properties and proportions of the fatty acid constituents of the glycerolipids, can also be manipulated by combining biomass (or oil) from at least two distinct species of microalgae. In some embodiments, at least two of the distinct species of microalgae have different glycerolipid profiles. The distinct species of microalgae can be cultured together or separately as described herein, preferably under heterotrophic conditions, to generate the respective oils. Different species of microalgae can contain different percentages of distinct fatty acid constituents in the cell's glycerolipids.

In some embodiments, the microalgal oil is primarily comprised of monounsaturated oil. In some cases, the algal oil is at least 20% monounsaturated oil by weight. In various embodiments, the algal oil is at least 25%, 50%, 75% or more monounsaturated oil by weight or by volume. In some embodiments, the monounsaturated oil is 18:1, 16:1, 14:1 or 12:1. In some embodiments, the microalgal oil comprises at least 10%, 20%, 25%, or 50% or more esterified oleic acid or esterified alpha-linolenic acid by weight of by volume. In at least one embodiment, the algal oil comprises less than 10%, less than 5%, less than 3%, less than 2%, or less than 1% by weight or by volume, or is substantially free of, esterified docosahexanoic acid (DHA (22:6)). For examples of production of high DHA-containing microalgae, such as in *Crypthecodinium cohnii*, see U.S. Pat. Nos. 7,252,979, 6,812,009 and 6,372,460.

Microalgal biomass generated by culture methods described herein and useful in accordance to those embodiments of the present disclosure relating to high protein typically comprises at least 30% protein by dry cell weight. In some embodiments, the microalgal biomass comprises at least 40%, 50%, 75% or more protein by dry cell weight. In some embodiments, the microalgal biomass comprises from 30-75% protein by dry cell weight or from 40-60% protein by dry cell weight. In some embodiments, the protein in the microalgal biomass comprises at least 40% digestible crude protein. In other embodiments, the protein in the microalgal biomass comprises at least 50%, 60%, 70%, 80%, or at least 90% digestible crude protein. In some embodiments, the protein in the microalgal biomass comprises from 40-90% digestible crude protein, from 50-80% digestible crude protein, or from 60-75% digestible crude protein.

Microalgal biomass (and oil extracted therefrom), can also include other constituents produced by the microalgae, or incorporated into the biomass from the culture medium. These other constituents can be present in varying amounts depending on the culture conditions used and the species of microalgae (and, if applicable, the extraction method used to recover microalgal oil from the biomass). The other constituents can include, without limitation, phospholipids (e.g., algal lecithin), carbohydrates, soluble and insoluble fiber, glycoproteins, phytosterols (e.g., β-sitosterol, campesterol, stigmasterol, ergosterol, and brassicasterol), tocopherols, tocotrienols, carotenoids (e.g., α-carotene, β-carotene, and lycopene), xanthophylls (e.g., lutein, zeaxanthin, α-cryptoxanthin, and β-cryptoxanthin), proteins, polysaccharides (e.g., arabinose, mannose, galactose, 6-methyl galactose and glucose) and various organic or inorganic compounds (e.g., selenium). Microalgal sterols may have anti-inflammatory, anti-matrix-breakdown, and improvement of skin barrier effects when incorporated into a skincare product such as described in section IV(f) and Example 26.

In some cases, the biomass comprises at least 10 ppm selenium. In some cases, the biomass comprises at least 25% w/w algal polysaccharide. In some cases, the biomass comprises at least 15% w/w algal glycoprotein. In some cases, the biomass comprises between 0-115 mcg/g total carotenoids. In some cases, the biomass comprises at least 0.5% algal phospholipids. In some cases, the oil derived from the algal biomass contains at least 0.10 mg/g total tocotrienols. In some cases, the oil derived from the algal biomass contains between 0.125 mg/g to 0.35 mg/g total tocotrienols. In some cases, the oil derived from the algal biomass contains at least 5.0 mg/100 g total tocopherols. In some cases, the oil derived from the algal biomass contains between 5.0 mg/100 g to 10 mg/100 g tocopherols.

Processing Microalgal Biomass

Drying the microalgal biomass, either predominantly intact or in homogenate form, is advantageous to facilitate further processing or for use of the biomass in the methods and compositions described herein. Drying refers to the removal of free or surface moisture/water from predominantly intact biomass or the removal of surface water from a slurry of homogenized (e.g., by micronization) biomass.

In one embodiment, the concentrated microalgal biomass is drum dried to a flake form to produce algal flake, as described in part A of this section. In another embodiment, the concentrated microalgal biomass is spray or flash dried (i.e., subjected to a pneumatic drying process) to form a powder containing predominantly intact cells to produce algal powder, as described in part B of this section. In another embodiment, oil is extracted from the concentrated microalgal biomass to form algal oil, as described in part C of this section.

A. Algal Flake

Algal flake is prepared from concentrated microalgal biomass that is applied as a film to the surface of a rolling, heated drum. The dried solids are then scraped off with a knife or blade, resulting in a small flakes. U.S. Pat. No. 6,607,900 describes drying microalgal biomass using a drum dryer without a prior centrifugation (concentration) step, and such a process may be used in accordance with the methods of the present disclosure.

Because the biomass may be exposed to high heat during the drying process, it may be advantageous to add an antioxidant to the biomass prior to drying. The addition of an antioxidant will not only protect the biomass during drying, but also extend the shelf-life of the dried microalgal biomass when stored. In a preferred embodiment, an antioxidant is added to the microalgal biomass prior to subsequent processing such as drying or homogenization.

Additionally, if there is significant time between the production of the dewatered microalgal biomass and subsequent processing steps, it may be advantageous to pasteurize the biomass prior to drying. Free fatty acids from lipases may form if there is significant time between producing and drying the biomass. In one embodiment, the pasteurized microalgal biomass is an algal flake.

B. Algal Powder

Algal powder of the present disclosure is prepared from concentrated microalgal biomass using a pneumatic or spray dryer (see for example U.S. Pat. No. 6,372,460). In a spray dryer, material in a liquid suspension is sprayed in a fine droplet dispersion into a current of heated air. The entrained material is rapidly dried and forms a dry powder. In some cases, a pulse combustion dryer can also be used to achieve a powdery texture in the final dried material. In other cases, a combination of spray drying followed by the use of a fluid bed dryer is used to achieve the optimal conditions for dried microbial biomass (see, for example, U.S. Pat. No. 6,255,505). As an alternative, pneumatic dryers can also be used in the production of algal powder. Pneumatic dryers draw or entrain the material that is to be dried in a stream of hot air. While the material is entrained in the hot air, the moisture is rapidly removed. The dried material is then separated from the moist air and the moist air is then recirculated for further drying.

C. Algal Flour

Algal flour of the present disclosure is prepared from concentrated microalgal biomass that has been mechanically lysed and homogenized and the homogenate spray or flash dried (or dried using another pneumatic drying system). The production of algal flour requires that cells be lysed to release their oil and that cell wall and intracellular components be micronized or reduced in particle size to an average size of no more than 10 μm. The resulting oil, water, and micronized particles are emulsified such that the oil does not separate from the dispersion prior to drying. For example, a pressure disrupter can be used to pump a cell containing slurry through a restricted orifice valve to lyse the cells. High pressure (up to 1500 bar) is applied, followed by an instant expansion through an exiting nozzle. Cell disruption is accomplished by three different mechanisms: impingement on the valve, high liquid shear in the orifice, and sudden pressure drop upon discharge, causing an explosion of the cell. The method releases intracellular molecules. A Niro (Niro Soavi GEA) homogenizer (or any other high pressure homogenizer) can be used to process cells to particles predominantly 0.2 to 5 microns in length. Processing of algal biomass under high pressure (approximately 1000 bar) typically lyses over 90% of the cells and reduces particle size to less than 5 microns.

Alternatively, a ball mill can be used. In a ball mill, cells are agitated in suspension with small abrasive particles, such as beads. Cells break because of shear forces, grinding between beads, and collisions with beads. The beads disrupt the cells to release cellular contents. In one embodiment, algal biomass is disrupted and formed into a stable emulsion using a Dyno-mill ECM Ultra (CB Mills) ball mill. Cells can also be disrupted by shear forces, such as with the use of blending (such as with a high speed or Waring blender as examples), the french press, or even centrifugation in case of weak cell walls, to disrupt cells. A suitable ball mill including specifics of ball size and blade is described in U.S. Pat. No. 5,330,913.

The immediate product of homogenization is a slurry of particles smaller in size than the original cells that is suspended in oil and water. The particles represent cellular debris. The oil and water are released by the cells. Additional water may be contributed by aqueous media containing the cells before homogenization. The particles are preferably in the form of a micronized homogenate. If left to stand, some of the smaller particles may coalesce. However, an even dispersion of small particles can be preserved by seeding with a microcrystalline stabilizer, such as microcrystalline cellulose.

To form the algal flour, the slurry is spray or flash dried, removing water and leaving a dry power containing cellular debris and oil. Although the oil content of the powder can be at least 10, 25 or 50% by weight of the dry powder, the powder can have a dry rather than greasy feel and appearance (e.g., lacking visible oil) and can also flow freely when shaken. Various flow agents (including silica-derived products) can also be added. After drying, the water or moisture content of the powder is typically less than 10%, 5%, 3% or 1% by weight. Other dryers such as pneumatic dryers or pulse combustion dryers can also be used to produce algal flour.

The oil content of algal flour can vary depending on the percent oil of the algal biomass. Algal flour can be produced from algal biomass of varying oil content. In certain embodiments, the algal flour is produced from algal biomass of the same oil content. In other embodiments, the algal flour is produced from algal biomass of different oil content. In the latter case, algal biomass of varying oil content can be combined and then the homogenization step performed. In other embodiments, algal flour of varying oil content is produced first and then blended together in various proportions in order to achieve an algal flour product that contains the final desired oil content. In a further embodiment, algal biomass of different lipid profiles can be combined together and then homogenized to produce algal flour. In another embodiment, algal flour of different lipid profiles is produced first and then blended together in various proportions in order to achieve an algal flour product that contains the final desired lipid profile.

D. Algal Oil

Algal oil can be separated from lysed biomass. The algal biomass remaining after oil extraction is referred to as delipidated meal, delipidated cells, or delipidated biomass. Delipidated meal contains less oil by dry weight or volume than the microalgae contained before extraction. Typically 50-90% of oil can be extracted so that delipidated meal contains, for example, 10-50% of the oil content of biomass before extraction.

In some embodiments, the algal oil is at least 50% w/w oleic acid and contains less than 5% DHA. In some embodiments of the method, the algal oil is at least 50% w/w oleic acid and contains less than 0.5% DHA. In some embodiments of the method, the algal oil is at least 50% w/w oleic acid and contains less than 5% glycerolipid containing carbon chain length greater than 18. In some cases, the algal cells from which the algal oil is obtained comprise a mixture of cells from at least two distinct species of microalgae. In some cases, at least two of the distinct species of microalgae have been separately cultured. In at least one embodiment, at least two of the distinct species of microalgae have different glycerolipid profiles. In some cases, the algal cells are cultured under heterotrophic conditions. In some cases, all of the at least two distinct species of microalgae contain at least 10%, or at least 15% oil by dry weight.

Microalgae containing lipids can be lysed to produce a lysate. As detailed herein, the step of lysing a microorganism (also referred to as cell lysis) can be achieved by any convenient means, including heat-induced lysis, adding a base, adding an acid, using enzymes such as proteases and polysaccharide degradation enzymes such as amylases, using ultrasound, mechanical pressure-based lysis, and lysis using osmotic shock. Each of these methods for lysing a microorganism can be used as a single method or in combination simultaneously or sequentially. The extent of cell disruption can be observed by microscopic analysis. Using one or more of the methods above, typically more than 70% cell breakage is observed. Preferably, cell breakage is more than 80%, more preferably more than 90% and most preferred about 100%.

Combining Microalgal Biomass or Materials Derived Therefrom with Other Industrial Lubricant Ingredients In one aspect, provided is a method of combining microalgal biomass with at least one other metalworking fluid ingredient to form a metalworking fluid composition.

In some cases, the metalworking fluid composition formed by the combination of microalgal biomass comprises at least 1%, at least 5%, at least 10%, at least 25%, or at least 50% w/w microalgal biomass. In some embodiments, the oil of microalgal biomass of the metalworking composition has a fatty acid profile of at least 50%, at least 60%, at least 70%, at least 80%, at least 85%, at least 90%, or at least 95% oleic acid. In some cases, the fatty acid profile has less than 6%, 5%, 4%, 3%, 2%, 1%, 0.9%, 0.8%, 0.7%, 0.6%, 0.5%, 0.4%, 0.3%, 0.2%, 0.1%, 0.05%, or 0.01% polyunsaturated fatty acids.

In some cases, the metalworking fluid composition formed by the combination of microalgal oil comprises at least 1%, at least 5%, at least 10%, at least 25%, at least 50%, at least 70%, at least 90%, or at least 99% w/w microalgal oil. In some embodiments, metalworking fluid compositions formed as described herein comprise at least 2%, at least 3%, at least 4%, at least 15%, at least 20%, at least 30%, at least 35%, at least 40%, at least 45%, at least 55%, at least 60%, at least 65%, at least 70%, at least 75%, at least 80%, at least 85%, at least 90%, or at least 95% w/w microalgal oil. In some embodiments, the microalgal oil of the metalworking composition has a fatty acid profile of at least 75%, at least 80%, at least 85%, or at least 90% oleic acid. In some cases, the fatty acid profile has less than 6%, 5%, 4%, 3%, 2%, 1%, 0.9%, 0.8%, 0.7%, 0.6%, 0.5%, 0.4%, 0.3%, 0.2%, 0.1%, 0.05%, or 0.01% polyunsaturated fatty acids.

In some cases, the metalworking fluid composition formed by the combination of microalgal fatty acid esters comprises at least 1%, at least 5%, at least 10%, at least 25%, at least 50%, at least 70%, at least 90%, or at least 99% w/w microalgal fatty acid esters. In some embodiments, metalworking fluid compositions formed as described herein comprise at least 2%, at least 3%, at least 4%, at least 15%, at least 20%, at least 30%, at least 35%, at least 40%, at least 45%, at least 55%, at least 60%, at least 65%, at least 70%, at least 75%, at least 80%, at least 85%, at least 90%, or at least 95% w/w microalgal fatty acid esters. In some embodiments, the microalgal fatty acid esters of the metalworking composition has a fatty acid profile of at least 75%, at least 80%, at least 85%, or at least 90% oleic acid. In some cases, the fatty acid profile has less than 6%, 5%, 4%, 3%, 2%, 1%, 0.9%, 0.8%, 0.7%, 0.6%, 0.5%, 0.4%, 0.3%, 0.2%, 0.1%, 0.05%, or 0.01% polyunsaturated fatty acids.

In some cases, the metalworking fluid comprises predominantly intact microalgal cells. In some cases, the composition comprises at least 50% intact cells, or at least 60%, at least 70%, or at least 80% intact cells, or at least 90% intact cells.

A. Substitution of Algal Biomass, Algal Oil, and Algal Oil Derivatives in Industrial Lubricants In some cases, microalgal biomass can be substituted for other components that would otherwise be conventionally included in a metalworking fluid product. In at least one embodiment, the metalworking fluid composition formed by the methods of the invention is free of oil other than microalgal oil contributed by the microalgal biomass and entrapped therein.

In various embodiments, microalgal biomass can be substituted for all or a portion of conventional metalworking fluid ingredient such as lubricants, emulsifiers, and the like, to the extent that the components of the microalgal biomass replace the corresponding conventional components in like kind, or adequately substitute for the conventional components to impart the desired characteristics to the metalworking fluid composition.

B. Other Metalworking Fluid Ingredients

Microalgal biomass and microalgal oil and oil derivatives are combined with at least one other metalworking fluid ingredients in methods of the present disclosure to form metalworking fluid compositions. The at least one other metalworking fluid ingredient can be selected from conventional metalworking fluid ingredients suitable for use with the microalgal biomass or microalgal oil with regard to the intended use of the composition. Such other metalworking fluid ingredients include, without limitation, antifoaming agents, antimicrobial agents, binders, biocides, bacteriocides, fungicides, chelating agents, chemical additives, pH adjusters, emulsifiers, lubricity agents, vegetable oils, petroleum derived oils, petroleum derivatives, corrosion inhibitors, extreme pressure additives, defoamers, alkaline reserves, antimisting agents, couplers, odorants, surfactants, humectants, rheology modifiers, dyes, and other additives.

Specific examples of other metalworking fluid ingredients are described below. Any one or more of these can be optionally combined with microalgal biomass, microalgal oil, or derivatives of microalgal oil in accordance with the present disclosure to form a metalworking fluid composition. The ingredients described below are categorized by their benefit or their postulated mode of action in a metalworking fluid. However, it is to be understood that these ingredients can in some instances provide more than one function and/or operate via more than one mode of action. Therefore, classifications herein are made for the sake of convenience and are not intended to limit the ingredient to that particular application or applications listed.

An effective amount of an anti-foaming agent can optionally be added to the compositions of the present disclosure, preferably from about 0.1% to about 3%, more preferably from about 0.5% to about 1%, of the composition. The anti-foaming agent reduces or controls the foaming properties of the fluid, e.g., such agents contribute to an acceptable low level of foam. The exact amount of anti-foaming agent to be used in the compositions will depend on the particular anti-foaming agent utilized since such agents vary widely in potency.

Anti-foaming agents, including but not limited to, are silicones, waxes, calcium nitrates, and calcium acetate.

The metalworking compositions of the present disclosure may contain an effective amount of one or more antimicrobial agents, such that the resultant composition is safe and effective for preventing, prohibiting, or retarding microbial growth in the metalworking fluid. The compositions preferably contain from or about 0.005% to or about 6%, more preferably 0.01% to or about 3% antimicrobial agent. Antimicrobial agents may be broad spectrum or may target specific types of bacteria or fungus. The exact amount of antimicrobial agent to be used in the compositions will depend on the particular antimicrobial agent utilized since such agents vary widely in potency.

Antimicrobial agents may include but are not limited to 1,2-Benzisothiazolin-3-one, sodium omadine, phenolics, p-chloro-m-cresol, halogen substituted carbamates, isothiazolone derivatives, bromonitriles dinitromorpholines, amphotericin, triazine, BIT, MIT, potassium sorbate, sodium benzoate, and include those marketed under trade st, pyridinethione, polyquat, IPBC, OIT, CTAC, CMIT, glutaraldehyde, Bronopol, DBPNA, Grotan (Troy), BIOBAN (Dow).

The metalworking compositions of the present disclosure may contain an effective amount of one or more chelating agents, such that the resultant composition is effective for complexing with water hardness ions to stabilize the fluid. The compositions preferably contain from or about 0.005% to or about 5%, more preferably 0.01% to or about 2% chelating agent.

Chelating agents may include but are not limited to sodium ethylenediaminetetraacetic acid, ethylene glycol tetraacetic acid, phosphonates, and gluconates.

The metalworking compositions of the present disclosure may contain an effective amount of one or more pH adjusters, such that the resultant composition is effective for maintaining desired pH. The compositions preferably contain from or about 0.005% to or about 5%, more preferably 0.01% to or about 2% pH adjuster. The exact amount of pH agent to be used in the compositions will depend on the particular pH agent utilized since such agents vary widely in potency.

pH adjusters may include but are not limited to alkali hydroxides, sodium hydroxide, potassium hydroxide, triethanolamine, triethylamine, and alkanolamines.

The metalworking compositions of the present disclosure may contain an effective amount of one or more emulsifiers, such that the resultant composition maintains lubricant in suspension. The compositions preferably contain from or about 0.5% to or about 15%, more preferably 1% to or about 10% emulsifier. The exact amount of emulsifier to be used in the compositions will depend on the particular agent utilized since such agents vary widely in potency.

Emulsifiers may include but are not limited to sodium sulfonate, fatty acid soaps, nonionic ethoxylates, synthetic sulfonates, fatty acid amines, and amphoterics.

The metalworking compositions of the present disclosure may contain an effective amount of one or more lubricity agents, such that the resultant composition provides or increases film strength or a boundary effective for preventing metal-on-metal contact. The compositions preferably contain from or about 0.5% to or about 90% lubricity agent.

Lubricity agents may include but are not limited to napthenic oils, paraffinc oils, fatty acid esters, high molecular weight esters, glycol esters, ethylene oxide copolymers, polypropylene oxide copolymers, naturally occurring triglycerides, graphite, graphite fluoride, molybdenum disulfide, tungsten disulfide, tin sulfide, and boron nitride.

The metalworking compositions of the present disclosure may contain an effective amount of one or more corrosion inhibitors, such that the resultant composition is effective for preventing oxidation of metal parts and tools that come in contact with the composition. The compositions preferably contain from or about 0.005% to or about 5% of a corrosion inhibitor. We also found that metalworking compositions comprising microalgal biomass inhibited corrosion)

Corrosion inhibitors may include but are not limited to include amine carboxylates, amine dicarboxylates, amine tricarboxylates, amine alcohols, boramides, arylsulfonamido acids, sodium borate, sodium molybdate, sodium metasilicates, succinic acid metasilicates, succinic acid derivates, tolyl and benzotriazoles, and thiadiazoles.

The metalworking compositions of the present disclosure may contain an effective amount of one or more extreme pressure additives, such that the resultant composition is effective for preventing welding of metal. The compositions preferably contain from or about 5% to or about 30% extreme pressure additives.

Extreme pressure additives may include but are not limited to sulfurized hydrocarbons, sulfurized fatty acid esters, halogenated paraffins, halogenated waxes, halogenated fats, halogenated esters, and phosphate esters.

The metalworking compositions of the present disclosure may contain an effective amount of one or more rheology modifiers, such that the resultant composition demonstrates viscosity and flowability effective the intended use of the composition. The compositions preferably contain from or about 0.005% to or about 5%, more preferably 0.01% to or about 2% rheology modifiers.

Rheology modifiers may include but are not limited to hydroxyethyl cellulose, carboxymethyl cellulose, xanthan gum, guar gum, starch, or polyanionic cellulose.

The metalworking compositions of the present disclosure may contain an effective amount of one or more surfactants, such that the resultant composition demonstrates effective wettability and cleanability. The compositions preferably contain from or about 0.01% to or about 25%, more preferably 0.1% to or about 10% surfactants.

Surfactants may include but are not limited to alkoxylated alcohols alkoxylated nonylphenols.

C. Industrial Lubricant Compositions of Microalgal Biomass, Algal Oil, and Algal Oil Derivatives In one aspect, provided are metalworking compositions comprising at least 1% w/w microalgal biomass and/or microalgal oil and/or microalgal oil derivative. In some embodiments, the compositions comprise at least 2%, at least 5%, at least 10%, at least 15%, at least 20%, at least 25%, at least 30%, at least 35%, at least 40%, at least 45%, at least 50%, at least 55%, at least 60%, at least 65%, at least 70%, at least 75%, at least 80%, at least 85%, at least 90%, or at least 95% microalgal biomass and/or microalgal oil and/or microalgal oil derivative. The remainder of a metalworking fluid composition in accordance with the present disclosure comprises water or other conventional ingredients, including those identified herein.

Metalworking fluid compositions can be in the form of a concentrated fluid. In other cases, the metalworking fluid compositions of the present disclosure are in a diluted form.

The microalgal biomass useful in the metalworking fluid compositions of the present disclosure can be derived from one or more species of microalgae cultured and/or genetically engineered as described herein.

In some embodiments, metalworking fluid compositions comprise at least 1% w/w microalgal oil, or a greater percentage as described above. The microalgal oil is derived from cultures of microalgae grown under heterotrophic conditions or those comprising at least 10% oil by dry cell weight, as described herein. In some cases, the microalgae can be genetically engineered.

In one embodiment, provided is a method of preparing a lubricant composition comprising (i) culturing a population of microalgae under conditions to generate microalgal biomass comprising at least 50% microalgal oil by dry weight, (ii) harvesting the biomass from the microalgal culture, (iii) performing one or more optional processing steps, e.g., drying the biomass or extracting oil from the biomass, (iv) combining the biomass with at least one other lubricant ingredient to form a lubricant.

Floor Sweep Compositions

In use, floor sweep compositions are scattered over the floor preliminary to the sweeping operation, to enable the composition to pick up and hold dust, particulates fluid, or other litter accumulated on the floor so that the floor may then be cleanly swept by the action of the broom or other sweeping agent. By thus causing the dust, particulates, fluid or litter to be accumulated on the sweeping composition, the sweeping operation may also be performed without the rising of dust under the action of the broom.

Floor sweep compositions are conventionally comprised of finely divided solid material and a moistening or wetting agent. Solid carriers such as sawdust, rice hulls, oat hulls, corncobs and sand have been used for years as a medium to which a wetting agent adheres. Sand, when used, functions as both a carrier and abrading cleaner, as well as a weighting compound to assure that the sweeping composition will "hug" the floor. Variable proportions of sand may be used, depending upon the age and the composition of the floor being cleaned. For example, with newly finished floors, sand in the composition is usually eliminated. However, as a floor gets older and abraded, sand is used to make sure that the composition effectively hugs the floor and causes slight abrasion to enhance cleaning.

Conventional floor sweep compositions typically comprise a petroleum-derived oil, such as a mineral oil or a bottoms residue from petroleum refinement, as wetting agent that serves additionally as a dust control agent. While often effective, petroleum-derived oil presents a disadvantage in that oil-saturated sweeping compound becomes an environmental pollutant, disposal of which may often be difficult.

An unpleasant odor characteristic of petroleum-derived oil is a further disadvantage of some conventional floor sweep compositions.

Biologically-derived alternatives to petroleum-derived oil wetting agents have been incorporated into floor sweep compositions that demonstrate improved odor characteristics and ameliorate the environmental pollutant disadvantage characteristic of floor sweep compositions prepared with petroleum-derived oil. Some 'natural; wetting agent alternatives include vegetable oils and water.

An further disadvantage of some conventional floor sweep compositions comprising petroleum-derived oil, vegetable oil, or is that upon storage, the oil wetting agent.

There is therefore a continuing need for development of effective floor sweep compositions that avoid the inherent odor, disposal, and leakage problems of an petroleum-based oil additive, or at least reduce the petroleum-based oil content, but at the same time, will still provide the effective dust control normally associated with oil use.

In one aspect, provided is a method of combining microalgal biomass with at least one other floor sweep ingredient to form a floor sweep composition.

In some cases, the floor sweep composition formed by the combination of microalgal biomass comprises at least 1%, at least 5%, at least 10%, at least 25%, at least 50%, at least 70%, or at least 90% w/w microalgal biomass. In some embodiments, the oil of microalgal biomass of the floor sweep composition has a fatty acid profile of at least 40%, at least 50%, at least 60%, at least 70%, at least 80%, at least 85%, at least 90%, or at least 95% oleic acid. In some embodiments, the oil of microalgal biomass of the floor sweep composition has a fatty acid profile of at least 40%, at least 50%, at least 60%, at least 70%, or at least 75% lauric acid. In some cases, the fatty acid profile has less than 6%, 5%, 4%, 3%, 2%, 1%, 0.9%, 0.8%, 0.7%, 0.6%, 0.5%, 0.4%, 0.3%, 0.2%, 0.1%, 0.05%, or 0.01% polyunsaturated fatty acids.

In some cases, the floor sweep composition formed by the combination of microalgal biomass comprises at least 1%, at least 5%, at least 10%, at least 25%, at least 50%, at least 70%, or at least 90% w/w delipidatated microalgal biomass.

In some cases, the floor sweep composition comprises predominantly intact microalgal cells. In some cases, the floor sweep composition comprises at least 50% intact cells, or at least 60%, at least 70%, or at least 80% intact cells, or at least 90% intact cells.

In some cases, the floor sweep composition formed by the combination of microalgal biomass comprises predominantly delipidated microalgal meal. In some cases, the floor sweep composition comprises at least 50%, or at least 60%, at least 70%, or at least 80%, or at least 90% delipidated microalgal meal.

In some cases, the floor sweep composition formed by the combination of microalgal biomass comprises a blend of delipidated microalgal meal and intact microalgal cells. In some cases, the floor sweep composition comprises a blend of equal parts delipidated microalgal meal and intact microalgal cells.

A. Substitution of Algal Biomass, Algal Oil, and Algal Oil Derivatives in Floor Sweep Products In some cases, microalgal biomass can be substituted for other components that would otherwise be conventionally included in a floor sweep product. In at least one embodiment, the floor sweep composition formed by the methods of the present disclosure is free of oil other than microalgal oil contributed by the microalgal biomass and entrapped therein.

In various embodiments, microalgal biomass can be substituted for all or a portion of conventional floor sweep ingredients such as absorbents, abrasives, carriers, and the like, to the extent that the components of the microalgal biomass replace the corresponding conventional components in like kind, or adequately substitute for the conventional components to impart the desired characteristics to the floor sweep composition.

In some cases, microalgal oil can be substituted for oils conventionally used in floor sweep compositions. As described herein, oils produced by microalgae can be tailored by culture conditions or lipid pathway engineering to comprise particular fatty acid components. Thus, the oils generated by the microalgae the present disclosure can be used to replace conventional floor sweep ingredients such as mineral oils, vegetable oils, and the like. In at least one embodiment, the floor sweep composition formed by the methods the present disclosure is free of oil other than microalgal oil.

B. Other Floor Sweep Ingredients

Microalgal biomass and microalgal oil are combined with at least one other floor sweep ingredient in methods the present disclosure to form floor sweep compositions. The at least one other floor sweep ingredient can be selected from conventional floor sweep ingredients suitable for use with the microalgal biomass or microalgal oil with regard to the intended use of the composition. Such other floor sweep ingredients include, without limitation, absorbents, abrasants, binders, antimicrobial agents, vegetable oils, petroleum derived oils, odorants, dyes, weighting agents, and other additives.

Specific examples of other floor sweep ingredients are described below. Any one or more of these can be optionally combined with microalgal biomass, microalgal oil, or derivatives in accordance with the present disclosure to form a floor sweep composition. The ingredients described below are categorized by their benefit or their postulated mode of action in a floor sweep composition. However, it is to be understood that these ingredients can in some instances provide more than one function and/or operate via more than one mode of action. Therefore, classifications herein are made for the sake of convenience and are not intended to limit the ingredient to that particular application or applications listed.

An effective amount of one or more absorbent agent can optionally be added to the compositions of the present disclosure, preferably from about 1% to about 90%, more preferably from about 1% to about 70%, of the composition. The absorbent agent attracts liquids or solid particles. The exact amount of absorbent agent to be used in the compositions will depend on the particular absorbent agent utilized since such agents vary widely in potency and vary in selectivity.

Exemplary absorbent agents include without limitation ground corncobs, soybean hulls, cellulose, sawdust, cotton fabric, newspaper, superabsorbents, acrylate copolymers, calcium carbonate, and calcium chloride.

An effective amount of one or more binding agent can optionally be added to the compositions of the present disclosure, preferably from about 1% to about 20% of the composition. The binding agent binds. Binding agents may include vegetable oil, soapstock, acid oil, glycerin, mineral oil, paraffin wax, and rubber.

Exemplary binding agents may include water, vegetable oil, soapstock, acid oil, glycerin, mineral oil, paraffin wax, rubber, and processed tires.

An effective amount of one or more weighting agent can optionally be added to the compositions of the present disclosure, preferably from about 1% to about 20% of the composition. The weighting agent adds mass to the composition and influences its flow or spreading properties.

Exemplary weighting agents may include sand, silica, volcanic ash, marble dust, limestone, and dyes.

The floor sweep compositions of the present disclosure may contain an effective amount of one or more antimicrobial agents, such that the resultant composition is safe and effective for preventing, prohibiting, or retarding microbial growth in the floor sweep. The compositions preferably contain from or about 0.005% to or about 6%, more preferably 0.01% to or about 3% antimicrobial agent. Antimicrobial agents may be broad spectrum or may target specific types of bacteria or fungus. The exact amount of antimicrobial agent to be used in the compositions will depend on the particular antimicrobial agent utilized since such agents vary widely in potency.

Antimicrobial agents may include but are not limited to 1,2-Benzisothiazolin-3-one, sodium omadine, phenolics, p-chloro-m-cresol, halogen substituted carbamates, isothiazolone derivatives, bromonitriles dinitromorpholines, amphotericin, triazine, BIT, MIT, potassium sorbate, sodium benzoate, and include those marketed under trade names Proxel GXL, pyridinethione, polyquat, IPBC, OIT, CTAC, CMIT, glutaraldehyde, Bronopol, DBPNA, Grotan (Troy), BIOBAN (Dow). such as marketed by Chantal Pharmaceutical of Los Angeles, Calif. under the trade names ETHOCYN and CYOCTOL, and 2-(5-ethoxy hept-1-yl)bicylo [3.3.0]octanone).

C. Floor Sweep Compositions of Microalgal Biomass, Algal Oil, and Algal Oil Derivatives In one aspect, provided are floor sweep compositions comprising at least 1% w/w microalgal biomass and/or microalgal oil and/or microalgal oil derivative. In some embodiments, the compositions comprise at least 2%, at least 5%, at least 10%, at least 15%, at least 20%, at least 25%, at least 30%, at least 35%, at least 40%, at least 45%, at least 50%, at least 55%, at least 60%, at least 65%, at least 70%, at least 75%, at least 80%, at least 85%, at least 90%, or at least 95% microalgal biomass and/or microalgal oil and/or microalgal oil derivative. The remainder of a floor sweep composition in accordance with the present disclosure comprises water or other conventional ingredients, including those identified herein.

In some embodiments, compositions of the present disclosure comprise at least 1% w/w microalgal biomass, or a greater percentage as described above. The microalgal biomass comprises at least 10% microalgal oil by dry weight, and can include greater amounts of microalgal oil as well as other constituents as described herein.

The microalgal biomass useful in the floor sweep compositions of the present disclosure can be derived from one or more species of microalgae cultured and/or genetically engineered as described herein.

In some embodiments, floor sweep compositions provided herein comprise at least 1% w/w microalgal oil, or a greater percentage as described above. The microalgal oil is derived from cultures of microalgae grown under heterotrophic conditions or those comprising at least 10% oil by dry cell weight, as described herein. In some cases, the microalgae can be genetically engineered.

The floor sweep compositions provided herein comprise at least 1% w/w microalgal oil, or a greater percentage as described above. The microalgal oil is derived from cultures of microalgae grown under heterotrophic conditions or those comprising at least 10% oil by dry cell weight, as described herein. In some cases, the microalgae can be genetically engineered.

In one aspect, the floor sweep compositions provides advantages over other floor sweep compositions. For example, oil based floor sweep compositions cannot be disposed of without environmental restrictions and leave an oily residue sweeping. Water-based sweeping compounds cannot be broadcast over an entire floor area, but must be spread in a line and quickly swept up.

EXAMPLES

The following examples are offered to illustrate, but not to limit, the claimed invention.

Example 1

Strains were prepared and grown heterotrophically as described above and in WO2008/151149, WO2010/063031, WO2010/045368, WO2010/063032, WO2011/150411, WO2013/158938, 61/923,327 filed Jan. 3, 2014, PCT/US2014/037898 filed May 13, 2014, and in U.S. Pat. No. 8,557,249. Sample IA refers to triglyceride oil from *Chlorella* (*Auxenochlorella*) *protothecoides* cells (UTEX 250). Samples IB-IG are oil isolated from various strains originating from *Prototheca moriformis* (UTEX 1435) that were prepared and cultured to achieve the indicated fatty acid profile. UTEX 250 and 1435 are available from the University of Texas at Austin Culture Collection of Algae.

TABLE I

| Oil properties | | | | | | | | |
|---|---|---|---|---|---|---|---|---|
| Assay Fatty Acid Profile | Units | IA (UTEX 250) S106 | Sample IB (high C10-C12) S6207 | IC (laurate) S5223 | ID (high myristic) S4845 | IE (SOS) S7586 | IF (low poly-unsaturates) S6697 | IG (Oleic) S5587 |
| C8:0 | % | 0.00 | 1.02 | 0.35 | 0.00 | 0.00 | 0.00 | 0.00 |
| C10:0 | % | 0.08 | 40.45 | 18.18 | 0.04 | 0.03 | 0.03 | 0.01 |
| C12:0 | % | 0.22 | 45.00 | 45.92 | 0.89 | 0.19 | 0.06 | 0.03 |
| C14:0 | % | 1.29 | 4.00 | 12.92 | 56.94 | 0.47 | 0.35 | 0.41 |
| C16:0 | % | 17.44 | 2.33 | 6.34 | 14.98 | 3.03 | 3.29 | 3.31 |
| C18:0 | % | 1.66 | 0.27 | 0.51 | 0.68 | 56.75 | 2.87 | 2.22 |
| C18:1 | % | 59.12 | 4.24 | 10.12 | 20.51 | 33.90 | 89.94 | 86.17 |
| C18:2 | % | 15.17 | 1.62 | 3.32 | 4.26 | 1.94 | 1.03 | 5.50 |
| C18:3 ALPHA | % | 2.01 | 0.27 | 0.38 | 0.23 | 0.16 | 0.15 | 0.24 |
| C20:0 | % | 0.25 | 0.02 | 0.06 | 0.06 | 1.65 | 0.25 | 0.26 |
| DROPPING | ° C. | 10.5 | 22.2 | 27.2 | | | 2 | 0.3 |

TABLE I-continued

| Oil properties | | | | | | | | |
|---|---|---|---|---|---|---|---|---|
| Assay Fatty Acid Profile | Units | IA (UTEX 250) S106 | Sample IB (high C10-C12) S6207 | IC (laurate) S5223 | ID (high myristic) S4845 | IE (SOS) S7586 | IF (low poly-unsaturates) S6697 | IG (Oleic) S5587 |
| MELTING POINT (METTLER) AOCS Cc 18-80 | | | | | | | | |
| CLOUD POINT D97 | ° C. | | 12 | 17 | 29 | | −18 | −19 |
| POUR POINT D97 | ° C. | | 10 | 15 | 27 | | −20 | −21 |
| IODINE VALUE | unit | 85.6 | 8.8 | 18.7 | 27.7 | | 81.6 | 85.6 |
| OSI RANCIMAT (110° C.) AOCS Cd 12b-92 | hours | | 68.72 | 46.8 | 37.56 | | 57.6 | 19.35 |
| SMOKE POINT AOCS Cc 9a-48 | ° C. | | | | 150 | | 248 | 248 |
| SAPONIFICATION VALUE AOCS Cd 3-25 | mg KOH/g | | | 239.2 | | | | |
| ALPHA TOCOPHEROL | mg/100 g | 12.7 | — | | 0.22 | | — | — |
| B-SITOSTEROL | mg/100 g | 56.3 | — | | 6.51 | | 26.4 | 3.81 |
| BETA TOCOPHEROL | mg/100 g | — | — | | — | | — | — |
| BRASSICASTEROL | mg/100 g | 131 | — | | — | | — | — |
| CAMPESTEROL | mg/100 g | 16.8 | 11.9 | | 6.29 | 3.72 | 8.03 | 8.08 |
| CHOLESTEROL | mg/100 g | — | — | | — | | — | — |
| DELTA TOCOPHEROL | mg/100g | 5.47 | 0.76 | | 0.28 | 1.48 | — | 0.81 |
| ERGOSTEROL | mg/100 g | 130 | 59.2 | | 174 | 54.8 | 174 | 92 |
| GAMMA TOCOPHEROL | mg/100 g | 2.25 | — | | 0.28 | 0.83 | 0.57 | 0.12 |
| STIGMASTEROL | mg/100 g | 18.7 | 6.19 | | 16.3 | 13.3 | 15.7 | 11.6 |
| OTHER STEROLS | mg/100 g | 279 | 111 | | 151 | 139 | 98.3 | 130 |
| ALPHA TOCOTRIENOL | mg/g | 0.11 | | | 0.18 | 0.17 | | |
| BETA TOCOTRIENOL | mg/g | 0.02 | | | 0.04 | <0.01 | | |
| DELTA TOCOTRIENOL | mg/g | 0.06 | | | <0.01 | <0.01 | | |
| GAMMA TOCOTRIENOL | mg/g | 0.02 | | | 0.03 | 0.07 | | |
| TOTAL TOCOTRIENOLS | mg/g | 0.21 | | | 0.25 | 0.24 | | |

Example 2

In the following examples and tables, algal biomass was prepared from heterotrophically grown microalgae as described above and in WO2008/151149, WO2010/063031, WO2010/045368, WO2010/063032, WO2011/150411, WO2013/158938, 61/923,327 filed Jan. 3, 2014, PCT/US2014/037898 filed May 13, 2014, and in U.S. Pat. No. 8,557,249. Biomass samples IIA to IIE of Table II were isolated from various strains originating from *Prototheca moriformis* (UTEX 1435) that were prepared and cultured to achieve the indicated fatty acid profile. Delipidated algal meal was prepared from dried mircoalgal biomass as described above. Particle size was evaluated with a Microtrac laser diffraction particle size analyzer.

TABLE II

| Biomass properties | | | | | | | |
|---|---|---|---|---|---|---|---|
| | | Biomass Sample | | | | | |
| | | | | | Delipidated algal meal | | |
| Assay | Units | IIA (laurate) S8162 | IIB (very high oleic) S6697 | IIC (mid oleic) S3150 | IID (very high oleic) S6697 | IIE (high oleic) S5587 | IIF (high oleic) S5587 |
| C8:0 | % | 0.22 | 0.01 | 0.02 | 0.01 | 0.00 | 0.00 |
| C10:0 | % | 17.18 | 0.11 | 0.02 | 0.11 | 0.01 | 0.01 |
| C12:0 | % | 45.03 | 0.25 | 0.07 | 0.25 | 0.03 | 0.03 |
| C14:0 | % | 11.16 | 0.52 | 1.95 | 0.52 | 0.41 | 0.41 |

TABLE II-continued

| Biomass properties | | | | | | | |
|---|---|---|---|---|---|---|---|
| | | Biomass Sample | | | | | |
| | | | | | Delipidated algal meal | | |
| Assay | Units | IIA (laurate) S8162 | IIB (very high oleic) S6697 | IIC (mid oleic) S3150 | IID (very high oleic) S6697 | IIE (high oleic) S5587 | IIF (high oleic) S5587 |
| C16:0 | % | 6.21 | 3.96 | 29.26 | 3.96 | 3.31 | 3.31 |
| C18:0 | % | 1.12 | 2.85 | 2.77 | 2.85 | 2.22 | 2.22 |
| C18:1 | % | 13.36 | 89.50 | 57.01 | 89.50 | 86.17 | 86.17 |
| C18:2 | % | 4.72 | 1.16 | 6.66 | 1.16 | 5.50 | 5.50 |
| C18:3 ALPHA | % | 0.46 | 0.20 | 0.33 | 0.20 | 0.24 | 0.24 |
| Total Lipid by Weight | % | 62.2 | 58.45 | 56.3 | 18.93 | 11.85 | 9.17 |
| Ash, AOAC 942.05 | % | 5.91 | 7.07 | 2.63 | 4.67 | 5.52 | 6.93 |
| Protein, AOAC 990.03 | % | 3.37 | 3.08 | 2.36 | 4.62 | 6.27 | 5.41 |
| Moisture, AOAC 930.15 | % | 3.65 | 4.76 | 2.37 | 1.73 | 1.82 | 2.45 |
| Fiber, AOAC 978.10 | % | 10.09 | 9.00 | 7.64 | 2.92 | 5.26 | 3.07 |
| pH, AOAC 973.41 | | 5.11 | 5.76 | 4.54 | 4.50 | 4.22 | 4.67 |
| PS D10 | micron | 6.2 | 5.04 | 4.7 | | | 72 |
| PS D50 | micron | 20.6 | 9.51 | 7.2 | | | 402 |
| PS D90 | micron | 88.3 | 57.6 | 11.4 | | | 982 |

Example 3: Dispersions of Predried Algal Biomass in Water

This example describes a procedure used to achieve a dispersion of a previously dried microalgal biomass in water that is similar to that of undried cells. Particle size was evaluated with a Microtrac laser diffraction particle size analyzer.

Upon growth in fermentation, cells of *Prototheca moriformis* UTEX 1435 were characterized by a particle size distribution shown in Table III. Dried cells *Prototheca moriformis* formed 40-4,000 um sized clusters in the form of a powdery flake. Dried microalgal biomass was added to water at a loading of 15% by weight. The mixture was then mixed with a low shear overhead mixer for 15 seconds. A uniform dispersion was obtained. The resulting solution was then mixed with a Silverson stationary high shear mixer at 10,000 rpm for one minute. Table III shows wet particle size distribution of the pre-dried microalgal biomass re-suspended in water.

These results indicate that mixing techniques practiced were sufficient to generate a particle size distribution that approximates that of the pre-dried particle size distribution of cells in fermentation broth.

TABLE III

| Particle size distribution | | |
|---|---|---|
| Percent Volume Cutoff | Cells in Fermentation Broth, Wet Particle Size (um) | Suspension of Dried Algae, Wet Particle Size (um) |
| d5 | 1.32 | 1.55 |
| d10 | 1.60 | 1.92 |
| d50 | 7.87 | 6.85 |
| d90 | 11.33 | 13.45 |
| d95 | 12.86 | 16.82 |

Example 4: Dry Films Prepared with Microalgal Biomass

This example describes formulations of microalgal biomass lubricants and their coating onto heated aluminum to form films.

Prior to formulation, dried microalgal biomass samples were characterized by properties listed in Table II. Base lubricant formulations were prepared according to recipes listed in Table IV. Formulation components included carboxymethyl cellulose (FinnFix LC) and surfactants such as Sodium Lauryl Sulfate (Ambion), Tergitol Minfoam 1× (Sigma), and Tween20. A biocide, WT-22 (Anchor Drilling Fluids), containing formaldehyde and Proxel GXL containing 1,2-benzisothiazolin-3-one in dipropylene glycol (Excel Industries) were also examined Proxel GXL was used at 10%-100% the dosing amount of WT-22. When Proxel GXL was used instead of WT-22, the weight percent of deionized water was adjusted accordingly (see Table IV) to produce a lubricant formulation that totaled 100%. WT-22 or Proxel GXL were both effective as biocides. Mixing of the concentrated formulations was achieved with a Silverson overhead high shear mixer. Upon mixing, the pH of each formulations was raised to approximately 8.8-9.2 by addition of base (typically NaOH, KOH, $NH_4OH$, TEA or the like). Formulations were stored in glass jars under ambient conditions until evaluated. These formulae involved a 25% suspension of microalgal biomass, such that a 9:1 dilution (10× dilution) with water would yield a 2.5% microalgal biomass solution. The average particle size distributions for 2.5% suspension of microalgal biomass (mid oleic biomass of Table II) in water is shown in Table IVa.

TABLE IV

| Lubricant formulations prepared with microalgal biomass | | | | | | | | | |
|---|---|---|---|---|---|---|---|---|---|
| | | Sample | | | | | | | |
| Component | | B-1 | B-2 | B-3 | B-4 | B-5 | B-6 | B-7 | B-8 |
| Dried microalgal biomass | Weight % | 25 | 25 | 25 | 25 | 25 | 25 | 25 | 25 |
| Carboxymethyl cellulose (CMC) | Component of Formulation | 3 | 1 | 1 | 3 | 1 | 3 | 1 | 3 |
| Tergitol Minfoam 1X | | 0 | 0 | 0.5 | 0.5 | 0 | 0 | 0 | 0 |
| Sodium Laureth Sulfate | | 0 | 0 | 0 | 0 | 0.5 | 0.5 | 0 | 0 |
| Tween 20 | | 0 | 0 | 0 | 0 | 0 | 0 | 0.5 | 0.5 |
| WT-22 | | 0 | 0 | 0.1 | 0.1 | 0.1 | 0.1 | 0.1 | 0.1 |
| DI Water | | 72 | 76 | 73.4 | 70.4 | 73.4 | 70.4 | 73.4 | 70.4 |

TABLE IVa

| Particle size for aqueous lubricant formulations with 2.5% intact microalgal biomass | |
|---|---|
| Distribution | Particle size (microns) |
| D10 | 1.22 |
| D50 | 7.19 |
| D90 | 26.3 |

Upon mixing, each formulation displayed uniform suspension over a two-day period. It was found that a CMC concentration between 1% and 3% yielded a solution able to hold dried microalgal cells in suspension. A Tergitol Minfoam 1× concentration of 0.5% yielded a surface tension suitable for coating metal and mitigating the Leidenfrost effect.

Prior to spray coating evaluation, formulations were diluted into water at a 9:1 dilution. The concentrated formulation was weighed into a 50 mL conical. DI water was then added and the mixture was shaken until uniform. With the aid of an external mix, two fluid nozzle, diluted formulations were spray applied onto an aluminum or steel platen heated to either 220° C. or 320° C. Each solution was atomized with an airline pressurized to 18 psi. A spray angle of 45° and a distance of nine inches from the platen were selected for optimal coating. An application rate of roughly 30 mL/min was used for 20 seconds to deliver the microalgal formulation onto the platen.

Dried films were evaluated by light microscopy Films formed on an aluminum platen heated to 220° C. were characterized by largely intact encapsulated oil bodies with few free oil droplets. Films formed on an aluminum or steel platen heated to 320° C. in contrast were characterized by fewer intact encapsulated oil bodies and far greater number of free oil droplets. Both temperature regimes resulted in films that were dry, stable, and resistant to physical disruption.

These results demonstrate conditions and formulations comprising microencapsulated algal oil capable of generating solid films adherent to a metal surface.

Example 5: Coefficient of Friction of Microalgal Biomass Under Various Conditions as Determined by Steel Falex Pin and Vee Block Tests This example compares the lubricating properties of formulations comprising microalgal biomass to those of formulations with graphite under stresses relevant to metal-working fluids.

Microaglal biomass samples IIA, IIB, and IIC of Example 2, heat treated biomass samples, as well as evaporated fermentation broth were used in the formulations and testing described below. Formulations were prepared according to recipes listed in Table IV. Mixing of the concentrated formulations was achieved with a Silverson overhead high shear mixer. pH was adjusted to approximately 8.8-9.2 with concentrated NaOH. Formulations were held in glass jars under ambient conditions until evaluated. Prior to pin and vee evaluation, these formula were subsequently diluted with water or used without dilution with water to the final solids value listed in Table VI.

Different lubricant exposure methods were evaluated for delivering formulations to the pin and vee apparatus. As noted in Table VI, vee blocks were either immersed in the test lubricant (wet), or were spray coated (dry) while being heated to different temperatures using the procedure described in Example 4. Vee blocks were coated while held under ambient conditions, or where noted, while blocks rested on a hot plate heated to either 220° C. of 320° C.

TABLE V

| Concentrated formulations | | | | | | | | | | | | | | | |
|---|---|---|---|---|---|---|---|---|---|---|---|---|---|---|---|
| | | Sample | | | | | | | | | | | | | |
| Component | | D1 | D2 | D3 | H1 | H2 | H3 | H4 | H5 | H6 | D4 | D5 | D6 | D7 | D8 |
| Dried biomass Sample IIB-S6697 | Weight % Component | 25 | 0 | 0 | 0 | 0 | 0 | 0 | 0 | 0 | 0 | 0 | 0 | 0 | 0 |
| Dried biomass Sample IIA-S8162 | | 0 | 25 | 0 | 0 | 0 | 0 | 0 | 0 | 0 | 0 | 0 | 0 | 0 | 0 |

TABLE V-continued

| Concentrated formulations | | | | | | | | | | | | | | |
|---|---|---|---|---|---|---|---|---|---|---|---|---|---|---|
| | Sample | | | | | | | | | | | | | |
| Component | D1 | D2 | D3 | H1 | H2 | H3 | H4 | H5 | H6 | D4 | D5 | D6 | D7 | D8 |
| Dried biomass Sample IIC-S3150 | 0 | 0 | 25 | 0 | 0 | 0 | 0 | 0 | 0 | 25 | 0 | 0 | 0 | 0 |
| Dried biomass Sample IIA-S8162 heated to 175 C. for 2 hrs | 0 | 0 | 0 | 25 | 0 | 0 | 0 | 0 | 0 | 0 | 25 | 0 | 0 | 0 |
| Dried biomass Sample IIA-S8162 heated to 315 C. for 2 hrs | 0 | 0 | 0 | 0 | 25 | 0 | 0 | 0 | 0 | 0 | 0 | 25 | 0 | 0 |
| Dried biomass Sample IIC-S3150 heated to 175 C. for 2 hrs | 0 | 0 | 0 | 0 | 0 | 25 | 0 | 0 | 0 | 0 | 0 | 0 | 0 | 0 |
| Dried biomass Sample IIA-S3150 heated to 315 C. for 2 hrs | 0 | 0 | 0 | 0 | 0 | 0 | 25 | 0 | 0 | 0 | 0 | 0 | 0 | 0 |
| Dried biomass Sample IIB-S6697 heated to 175 C. for 2 hrs | 0 | 0 | 0 | 0 | 0 | 0 | 0 | 25 | 0 | 0 | 0 | 0 | 0 | 0 |
| Dried biomass Sample IIB-S6697 heated to 315 C. for 2 hrs | 0 | 0 | 0 | 0 | 0 | 0 | 0 | 0 | 25 | 0 | 0 | 0 | 0 | 0 |
| Evaporated microalgal fermentation broth, S3150 | 0 | 0 | 0 | 0 | 0 | 0 | 0 | 0 | 0 | 0 | 0 | 0 | 54.50 | 0 |
| Carboxy methyl cellulose | 0 | 0 | 0 | 0 | 0 | 0 | 0 | 0 | 0 | 1 | 1 | 1 | 1 | 0.5 |
| Tergitol Minfoam 1X | 0 | 0 | 0 | 0 | 0 | 0 | 0 | 0 | 0 | 0.5 | 0.5 | 0.5 | 0.5 | 0.5 |
| WT-22 | 0 | 0 | 0 | 0 | 0 | 0 | 0 | 0 | 0 | 0.1 | 0.1 | 0.1 | 0.1 | 0 |
| Graphite | 0 | 0 | 0 | 0 | 0 | 0 | 0 | 0 | 0 | 0 | 0 | 0 | 0 | 25 |
| DI Water | 75 | 75 | 75 | 73.4 | 75 | 75 | 75 | 75 | 75 | 73.4 | 43.9 | 73.4 | 43.9 | 74 |

TABLE VI

Formulations evaluated by Pin (#8 Test Pin, SAE3135 steel) and Vee Block (Standard Vee Block, AISI 1137 Steel) Apparatus testing

| Run # | Formulation Sample | Final Percent Solids Tested | Test Vee Block exposure Type | Dry Film coating Temperature Exposure (° C.) | CoF min Plateau | Pin Fail (lbs) |
|---|---|---|---|---|---|---|
| 1 | D1 | 25 | Wet | | 0.074 | N/A |
| 2 | D1 | 10 | Wet | | 0.077 | N/A |
| 3 | D1 | 5 | Wet | | 0.069 | N/A |
| 4 | D1 | 2.5 | Wet | | 0.057 | N/A |
| 5 | D2 | 25 | Wet | | 0.063 | N/A |
| 6 | D2 | 10 | Wet | | 0.089 | N/A |
| 7 | D2 | 5 | Wet | | 0.074 | N/A |
| 8 | D2 | 2.5 | Wet | | 0.069 | N/A |
| 9 | D2 | 2.5 | Wet | | 0.069 | N/A |
| 10 | H1 | 2.5 | Wet | | 0.064 | N/A |
| 11 | H3 | 2.5 | Wet | | 0.061 | N/A |
| 12 | D1 | 2.5 | Wet | | 0.085 | N/A |
| 13 | H5 | 2.5 | Wet | | 0.070 | N/A |
| 14 | H6 | 2.5 | Wet | | 0.087 | 926 |
| 15 | D3 | 2.5 | Wet | | 0.081 | N/A |
| 16 | H3 | 2.5 | Wet | | 0.051 | N/A |
| 17 | H4 | 2.5 | Wet | | 0.075 | 1575 |
| 18 | D8 | 2.5 | Wet | | 0.075 | N/A |
| 20 | D8 | 2.5 | Dry | | 0.741 | 151 |
| 21 | D2 | 2.5 | Dry | | 0.108 | 514 |
| 22 | D1 | 2.5 | Dry | | 0.068 | 698 |
| 23 | D3 | 2.5 | Dry | | 0.064 | 568 |
| 24 | D8 | 2.5 | Dry | | 0.141 | 428 |
| 26 | D4 | 2.5 | Dry | | 0.108 | 385 |
| 27 | D4 | 2.5 | Dry | | 0.107 | 329 |
| 28 | D4 | 2.5 | Dry | 220 | 0.063 | 728 |
| 29 | D4 | 2.5 | Dry | 220 | 0.063 | 707 |
| 30 | D4 | 2.5 | Dry | 320 | 0.082 | 536 |
| 31 | D4 | 2.5 | Dry | 320 | 0.072 | 605 |
| 32 | D8 | 10 | Dry | | 0.240 | 258 |
| 33 | D8 | 10 | Dry | | 0.200 | 343 |
| 34 | D8 | 10 | Dry | 220 | 0.134 | 592 |
| 35 | D8 | 10 | Dry | 220 | 0.120 | 657 |
| 36 | D8 | 10 | Dry | 320 | 0.112 | 734 |
| 37 | D8 | 10 | Dry | 320 | 0.114 | 840 |
| 38 | D7 | 2.5 | Dry | 220 | 0.075 | 581 |
| 39 | D7 | 2.5 | Dry | 220 | 0.067 | 514 |
| 40 | D7 | 2.5 | Dry | 320 | 0.096 | 694 |
| 41 | D7 | 2.5 | Dry | 320 | 0.107 | 681 |

N/A indicates that pin failure was not reached and that the test ran to the 3000 lbf limit of the machine.

Runs 1-18 were conducted such that liquid lubricant samples were exposed to the Falex pin and vee apparatus by full submersion. For runs 1-8, formulations were prepared with dried microalgal cells from either a high oleic content producing strain or a high lauric content producing strain. These formulations were characterized by coefficients of friction less than 0.08. Run 18 evaluated a formulation comprising graphite. In the full submersion Falex test, this formulation was characterized by a coefficient of friction of 0.075.

Runs 9-17 interrogated formulations prepared with dried microalgae that were heated to temperatures 175° C. or 315° C. for two hours prior to formulation. The heat exposed biomass was then suspended in water to a final concentration of 2.5% by weight. The resulting solutions were tested via the submerged pin and vee assay.

Runs 20-41 evaluated dry film coatings applied to vee blocks. Application was conducted either under ambient temperature, or while the vee blocks were heated to the temperatures indicated. The results show that the algal biomass film formulations achieve a lower coefficient of friction than the graphite film across all temperatures evaluated. As compared to graphite, the microalgal biomass samples show increased pin stability at ambient and 220° C. exposure, but decreased pin stability at 320° C.

Example 6: Dried Algal Biomass Demonstrates Low Volatile Organic Compounds

Dry encapsulated oil powder was subjected to test method ASTM E1868-10, Standard Test Method for Loss-On-Drying by Thermogravimetry. This test method was developed for metalworking fluids and direct-contact lubricants. Two different preparations of dried microalgal encapsulated oil were characterized by VOCs of 7.88 g/L (0.788%) and 9.16 g/L (0.916%).

Example 7: Floor Sweep Composition Comparison Test

A comparison test was developed to evaluate the performance of various floor sweep compositions against different dust and liquid targets. The testing apparatus consisted of five parallel lanes, each lane bounded by two 6 foot long solid metal strips. The strips were affixed to floor surface at intervals approximately 5.5 inches wide. Each lane was measured into five zones in order, a deposit zone, an advancing zone, a pick-up zone, a push thru zone, and a final evaluation zone.

At the beginning of each test, equivalent mass samples of various floor sweep compositions were deposited in the deposit zone. Equivalent masses of 'substrate' dust or liquid samples were deposited along each lane in the pick-up zone. The test substrate was applied was ⅓ the mass amount of floor sweep formulation tested.

With a 30-inch wide nylon boom, three brush strokes were exerted to advance the floor sweep compositions along the test zones of the floor surface. The brush first stroke moved floor sweep compositions from the deposit zone through the advancing zone. The second moved floor sweep compositions from the advancing zone through the pick-up zone. The third brush stoke moved the floor sweep compositions from the end of pick-up zone through to the final evaluation zone. Photographs of the test in progress were collected before test commencement, between brush strokes, and after test conclusion. Qualitative evaluations were noted.

Example 8: Improved Floor Sweep Compositions with Microalgal Biomass

This example describes the preparation of floor sweep compositions comprising microalgal biomass and their evaluation against conventional commercial floor sweep compositions.

Floor sweep compositions were prepared by combining the ingredients listed in Table XVI according to the weight percentages indicated. Ingredients were added to a heavy duty plastic bag then hand blended for 2 minutes. Dried algal biomass Sample C and delipidated algal meal Sample F of Example 2 were used in these formulations and were characterized by the properties listed in Table VII. Quikrete All Purpose Sand, corn cobs, hard wood saw dust, and conventional mineral oil or soybean oil floor sweep compositions were obtained commercially.

TABLE VII

Floor sweep formulations

| Sample Formulation | Descriptor | Ingredients | Weight % of Formulation |
|---|---|---|---|
| FS1 | Biomass & Sand | Algal Biomass Sample C - S3150 | 25 |
| | | Quikrete All Purpose Sand | 75 |
| FS2 | Blended biomass & sand | Algal Biomass Sample C - S3150 | 12.5 |
| | | Delipidated Biomass Sample F | 12.5 |
| | | Quikrete All Purpose Sand | 75 |

TABLE VII-continued

Floor sweep formulations

| Sample Formulation | Descriptor | Ingredients | Weight % of Formulation |
|---|---|---|---|
| FS3 | Delipidated biomass & sand | Delipidated Biomass Sample F | 25 |
| | | Quikrete All Purpose Sand | 75 |
| FS4 | MMC Green | Sawdust | 60 |
| | | Sand | 20 |
| | | Soybean oil | 20 |
| FS5 | MMC Mineral Oil | Sawdust | 60 |
| | | Sand | 20 |
| | | Mineral oil | 20 |
| FS6 | Blended biomass & saw dust | Algal Biomass Sample C - S3150 | 12.5 |
| | | Delipidated Biomass Sample F | 12.5 |
| | | Saw dust | 75 |
| FS7 | Blended biomass & corn cobs | Algal Biomass Sample C - S3150 | 12.5 |
| | | Delipidated Biomass Sample F | 12.5 |
| | | Corn cobs | 75 |
| FS8 | Delipidated biomass & corn cobs | Delipidated Biomass Sample F | 25 |
| | | Corn cobs | 75 |
| FS9 | Blended biomass, corn cobs and sand | Algal Biomass Sample C - S3150 | 12.5 |
| | | Delipidated Biomass Sample F | 12.5 |
| | | Corn cobs | 60 |
| | | Quikrete All Purpose Sand | 15 |

The floor sweep formulations of Table VII were evaluated by the test methodology outlined in Example 7. In this example, tracks of the testing apparatus were affixed to an unpolished concrete floor. Substrates challenged by the formulations are listed in Table VII along with a score that reflects formulation ease of advancement along the floor surface as well as absorbance of the target substrate. Scores are relative to a commercial, mineral oil based floor sweep composition. A score above 1 indicates improved performance, a score below indicates disadvantaged performance, and a score equal to 1 indicates equivalent performance relative to the commercial mineral oil based standard. Sets of samples and targets that were not assessed are indicated in Table VII as 'n.a.'.

TABLE VIII

Qualitative ranking results of floor sweep formulation testing

| Sample Formulation | Descriptor | Floor Sweep Substrate: Wheat Flour | Wood Flour | Talc | Water | Used Motor Oil |
|---|---|---|---|---|---|---|
| FS4 | MMC Green | 0 | 1 | 0 | 0 | −1 |
| FS5 | MMC Mineral Oil | 1 | 1 | 1 | 1 | 1 |
| FS1 | Biomass & Sand | 1 | n.a. | n.a. | n.a. | n.a. |
| FS2 | Blended biomass & sand | 0 | 2 | 1 | 0 | 2 |
| FS3 | Delipidated biomass & sand | −1 | n.a. | n.a. | n.a. | n.a. |
| FS6 | Blended biomass & sawdust | n.a. | 2 | 1 | 3 | 3 |
| FS7 | Blended biomass & corn cobs | n.a. | 2 | 1 | 3 | 3 |
| FS8 | Delipidated biomass & corn cobs | n.a. | 1 | 1 | 2 | 2 |
| FS9 | Blended biomass, corn cobs and sand | n.a. | 1 | 1 | 0 | 2 |

The results presented in Table VIII demonstrate that various floor sweep compositions comprising algal biomass tested against different floor sweep substrates show improved surface floor advancement and improved absorbance conjunction with different test substrates relative to conventional, commercial floor sweep formulations. Compositions with algal biomass are equivalent or more effective than conventional floor sweep formulations at removing talc from concrete floor surfaces. Compositions with algal biomass and either sawdust or corn cobs but without sand are more effective than conventional floor sweep formulations at removing water from concrete floor surfaces. Compositions with algal biomass and combinations of saw dust, corn cobs, or sand are more effective than conventional floor sweep formulations at removing used motor oil from concrete floor surfaces.

Example 9: Improved Absorbance Capacity of Floor Sweep Compositions with Microalgal Biomass This example compares the water and oil absorbance properties of microalgal biomass and floor sweep compositions comprising microalgal biomass to those of conventional floor sweep ingredients and conventional floor sweep compositions.

Floor sweep ingredients as well as blended floor sweep compositions were obtained or generated according to the procedures indicated Example 8. Five grams of each ingredient or formulation listed in Table IX was weighed into sets of paired 50 ml conical centrifuge tubes. 30 mls of room temperature $H_2O$ was added to one set of tubes, 20 mls of room temperature vacuum pump mineral oil was added to the second set of tubes. The suspensions were mixed by vortex mixer for 2 minutes then allowed to rest at ambient temperature for 1 hour. Suspensions were then centrifuged for 10 minutes at 12,000 g. Unabsorbed liquid from each sample was decanted. Pellets were then weighed. Fold absorbance was measured and is represented by the following formulation: ([(Mass of pellet after test)−(initial mass of sample evaluated)]/(initial mass of sample evaluated)).

TABLE IX

Water and Oil Absorbance of Floor Sweep Ingredients and Compositions

| Sample | Descriptor | Formulation Ingredients | Weight % in Formulation | Fold Absorbance: Water | Oil |
|---|---|---|---|---|---|
| AS1 | Blended biomass, corn cobs and sand | Algal Biomass Sample C - 3150 | 12.5 | 2.27 | 0.76 |
| | | Deplidated Biomass Sample F | 12.5 | | |
| | | Kwikrete multipurpose sand | 37.5 | | |
| | | Cornsorb Corncobs | 37.5 | | |
| AS2 | Blended biomass and corn cobs | Algal Biomass Sample C - 3150 | 12.5 | 2.42 | 0.89 |
| | | Deplidated Biomass Sample F | 12.5 | | |
| | | Cornsorb Corncobs | 75 | | |
| AS3 | Blended biomass, corn cobs and sand | Algal Biomass Sample C - 3150 | 12.5 | 1.78 | 1.1 |
| | | Deplidated Biomass Sample F | 12.5 | | |
| | | Kwikrete multipurpose sand | 15 | | |
| | | Cornsorb Corncobs | 60 | | |
| AS4 | Blended biomass, sawdust | Algal Biomass Sample C - 3150 | 12.5 | 1.62 | 0.59 |
| | | Deplidated Biomass Sample F | 12.5 | | |
| | | Smith Company Hammer milled sawdust | 75 | | |
| AS5 | Blended biomass, sawdust and sand | Algal Biomass Sample C - 3150 | 12.5 | 2.18 | 0.57 |
| | | Deplidated Biomass Sample F | 12.5 | | |
| | | Smith Company Hammer milled sawdust | 60 | | |
| | | Kwikrete multipurpose sand | 15 | | |
| AS6 | Blended biomass and sand | Algal Biomass Sample C - 3150 | 12.5 | 0.63 | 1.48 |
| | | Deplidated Biomass Sample F | 12.5 | | |
| | | Kwikrete multipurpose sand | 75 | | |
| AS7 | Sand | Kwikrete multipurpose sand | 100 | 0.3 | 1.63 |
| AS8 | Sawdust | Smith Company Hammer milled sawdust | 100 | 2.7 | 0.25 |

TABLE IX-continued

Water and Oil Absorbance of Floor Sweep Ingredients and Compositions

| Sample | Descriptor | Formulation Ingredients | Weight % in Formulation | Fold Absorbance Water | Fold Absorbance Oil |
|---|---|---|---|---|---|
| AS9 | Corncobs | Cornsorb Corncobs | 100 | 3.03 | 0.99 |
| AS10 | Algal Biomass Sample C - 3150 | Algal Biomass Sample C - 3150 | 100 | 0 | 0.68 |
| AS11 | Deplidated Biomass Sample F | Deplidated Biomass Sample F | 100 | 1.51 | 1.21 |
| AS12 | Green Commercial Floor Sweep | Sawdust | 59 | 0.6 | 1.37 |
| | | Sand | 20 | | |
| | | Wax | 20 | | |
| | | polyacrylamide superabsorbent | 1 | | |
| AS13 | Mineral oil Commercial Floor Sweep | Sawdust | 70 | 1.3 | 0.8 |
| | | Mineral oil | 30 | | |
| AS14 | Mineral Oil Commercial Floor Sweep | Sand | 20 | 0.82 | 1.35 |
| | | Sawdust | 60 | | |
| | | Mineral oil | 20 | | |

The results presented in Table IX demonstrate that various floor sweep compositions comprising algal biomass show improved water or oil fold absorbance relative to conventional, commercial floor sweep formulations. Samples AS1-AS5, comprising a blend of algal biomass, delipidated algal meal, and other ingredients were characterized by an improved fold water absorbance (ranging from 1.62-2.42) relative to the fold absorbance of commercial floor sweep compositions (0.6-0.8 fold). Sample AS6, a blend of algal biomass, delipidated algal meal, and sand was characterized by an equivalent or improved fold oil absorbance (1.48 fold) relative the fold absorbance of commercial floor sweep compositions (0.8-1.37 fold).

Example 10: Reduced Friction and Wear with Algal Biomass Formulations in Water This example compares the friction reduction and wear properties of formulations containing microalgal biomass to those of formulations with graphite or molybdenum disulfide under stresses relevant to metalworking fluids.

Prior to formulation, dried microalgal biomass samples were characterized by properties listed in Table II. Powder forms of solid lubricants were obtained from commercial sources: graphite (Asbury Carbon) and molybdenum disulfide (Climax Molybdenum). Powdered graphite was characterized by a particle size range of 0.5-50 micons. Powdered molybdenum disulfide was characterized by a particle size range of 0.5-5 micons. Base lubricant formulations were prepared according to recipes listed in Table X. Mixing of the concentrated formulations was achieved with a Silverson overhead high shear mixer or a low shear overhead mixer until the mixture was uniform. The pH of each formulation was raised then to approximately 8.8-9.2. Formulations were stored in glass jars under ambient conditions until evaluated. These formulae involved a 25% suspension, such that a 9 part water to 1 part formula dilution yielded a 2.5% solids solution, thus generating samples G-1 (containing 2.5% microalgal biomass), G-2 (containing 2.5% graphite), and G-3 (containing 2.5% $MoS_2$). Diluted formulations (2.5% solids) were evaluated according to ASTM D 3233 Method A, ASTM D 2670, ASTM D 4172, and ASTM D 2783. Results of these standardized tests are listed in Table XI.

TABLE X

Lubricant formulations

| Component | | Sample H-1 | Sample H-2 | Sample H-3 |
|---|---|---|---|---|
| Dried microalgal biomass | Weight % Component | 25 | 0 | 0 |
| Synthetic Dry Graphite | | 0 | 25 | 0 |
| Super Fine Molybdenum Disulfide | | 0 | 0 | 25 |
| Carboxymethyl cellulose | | 2 | 2 | 2 |
| Proxel ™ GTL (Lonza) | | 0.05 | 0.05 | 0.05 |
| DI Water | | 72.95 | 72.95 | 72.95 |

Diluted formulations (2.5% solids) were evaluated according to extreme pressure and wear tests ASTM D 3233 Method A, ASTM D 2670, ASTM D 4172, and ASTM D 2783. Results of these standardized tests are listed in Table XI.

TABLE XI

Results of Extreme Pressure and Wear Standardized Tests

| Test | Measure | Sample G-1 | Sample G-2 | Sample G-3 |
|---|---|---|---|---|
| ASTM D 2783, Standard Test Method for Measurement of Extreme-Pressure Properties of Lubricating Fluids (Four-Ball Method) | Weld point (kg) | 126 | 126 | 400 |
| | Last Non Seizure Load (kg) | 50 | 50 | 63 |
| | Wear Index | 19.07 | 27.74 | 90.9 |
| ASTM D 4172, Standard Test Method for Wear Preventive Characteristics of Lubricating Fluid (Four-Ball Method) | Average Scar Diameter (mm) | 1.046 | 1.682 | 1.254 |
| ASTM D 2670, Standard Test Method for Measuring Wear Properties of Fluid Lubricants (Falex Pin and Vee Block Method) | Tooth Wear (Teeth) | 13 | 48 | 39 |
| ASTM D 3233 Method A, Standard Test Methods for Measurement of Extreme Pressure Properties of Fluid Lubricants (Falex Pin and Vee Block Methods) | Coefficient of Friction (min) | 0.047 | 0.121 | 0.056 |
| | Load at Failure (lbs) | no fail | 2536 | no fail |

The results presented in Table XI demonstrate that the formulation prepared with microalgal biomass was characterized by reduced wear relative to those prepared with graphite or molybdenum disulfide. The wear results of ASTM D 2670 demonstrate that the formulation with microalgal biomass was characterized by two fold or lower wear in relation to formulations with either graphite or molybdenum disulfide. The wear results of ASTM D 4172 demonstrate that the formulation with microalgal biomass was characterized by 37% wear reduction relative to the formulation with graphite and a 16% wear reduction relative to the formulation with molybdenum disulfide.

The ASTM D 3233 Method A results presented in Table XI demonstrate that the formulation prepared with microalgal biomass was characterized a lower coefficient of friction relative to the formulations prepared with graphite or with molybdenum disulfide.

Example 11: Reduced Friction with Algal Biomass Formulations in Oil

This example compares the friction reduction and extreme pressure properties of oil-based formulations containing microalgal biomass, microalgal oil, or microalgal delipidated meal under stresses relevant to metalworking fluids.

Prior to formulation, dried microalgal biomass and microalgal delipidated meal samples were characterized by properties listed in Table II with the exception that both dried biomass and delipidated biomass were prepared to a final average particle size below 100 microns. Microalgal oil was characterized by properties listed in Table I, Sample IF (S6697). Petroleum derived Group II base oil, fumed silica, and bismuth octoate were obtained from commercial sources. Weight based formulations were prepared according to the recipes listed in Table XII. Mixing of sample formulation was achieved with an overhead low shear mixer utilizing a Cowles blade followed by an overhead high shear Silverson mixer until the mixture was uniform. Formulations were stored in glass jars under ambient conditions until they were evaluated according to the extreme pressure test ASTM D 3233 Method A, allowing the load to increase until pin failure. In the absence of pin failure, a load of 3,000 lbs or more was applied. Results of this standardized test are shown in Table XIII.

TABLE XII

Oil-Based Lubricant Formulations

| Component | | Sample I-1 | I-2 | I-3 | I-4 |
|---|---|---|---|---|---|
| Group II Paraffinic Base Oil | Weight % Component of Formulation | 97.7 | 96.2 | 95.2 | 96.7 |
| Microalgal Oil (S6697) | | 0 | 1.5 | 0 | 0 |
| Dried microalgal biomass | | 0 | 0 | 2.5 | 0 |
| Delipidated microalgal biomass | | 0 | 0 | 0 | 1 |
| Fumed Silica | | 0.1 | 0.1 | 0.1 | 0.1 |
| Bismuth Octoate | | 2.2 | 2.2 | 2.2 | 2.2 |

TABLE XIII

Results of Extreme Pressure Standardized Tests

| Test | Measure | Sample I-1 | I-2 | I-3 | I-4 |
|---|---|---|---|---|---|
| ASTM D 3233 Method A, Standard Test Methods for Measurement of Extreme Pressure Properties of Fluid Lubricants (Falex Pin and Vee Block Methods) | Load at Failure (lbs) | 202 | 520 | no fail | no fail |

The results presented in Table XIII demonstrate that the formulations prepared with microalgal biomass or with delipidated microalgal biomass in addition to fumed silica and bismuth octoate were able to lubricate the spinning pin to be able to withstand a load of 3,000 or greater. In contrast, formulations with microalgal oil or with Group II base oil alone, in addition to fumed silica and bismuth octoate, were unable to lubricate the pin above loads of 520 lbs.

Example 12: Twist Compression Tests with Algal Biomass Formulations

This example compares the friction reduction and load properties of formulations containing microalgal biomass to those containing graphite under stresses relevant to metalworking fluids.

Prior to formulation, dried microalgal biomass samples were characterized by properties listed in Table II. Powdered graphite was obtained from Asbury Carbon. Lubricant formulations were prepared according to recipes listed in Table XIV. Mixing of the formulations was achieved with a low shear mixer followed by a Silverson overhead high shear mixer until the mixture was uniform. The pH of each formulation was raised then to approximately 8.8-9.2. Formulations were stored in glass jars under ambient conditions until evaluated.

TABLE XIV

Formulations

| Component | | Sample J-1 | J-2 |
|---|---|---|---|
| Dried microalgal biomass | Weight % Component of Formulation | 25 | 0 |
| Synthetic Dry Graphite | | 0 | 25 |
| Carboxymethyl cellulose | | 2 | 2 |
| Proxel ™ GTL (Lonza) | | 0.05 | 0.05 |
| DI Water | | 72.95 | 72.95 |

The twist compression test was employed on dilutions of samples listed in Table XIV to evaluate the coefficient of friction of dry films adhered to aluminum 6061 and steel W-1 plates. Prior to evaluation, samples J-1 and J-2 were diluted in 3 parts water to 1 part formulation (4× dilution) to obtain formulations K-1 (microalgal biomass) and K-2 (graphite) with 6.25% solids. Aluminum 6061 plates, heated to 100° C., were spray coated with either K-1 or K-2 formulations. Films were allowed to dry under ambient conditions. An annular tool was then rotated at 10 rpm under pressure over the aluminum 6061 or steel W-1 plates on which the test lubricants had been spray applied. The pressure applied ranged from 1,000-5,000 psi. Data was collected electronically and the coefficient of friction was calculated from the ratio of transmitted torque to applied pressure. Results of these tests, run at the pressures indicated, are shown in Table XV.

TABLE XV

Twist Compression Test Results

| Test | Sample K-1 AL 1,000 psi | Sample K-1 AL 3,000 psi | Sample K-1 AL 5,000 psi | Sample K-1 Steel 20,000 PSI | Sample K-2 AL 1,000 psi | Sample K-2 AL 3,000 psi | Sample K-2 AL 5,000 psi | Sample K-2 Steel 20,000 PSI |
|---|---|---|---|---|---|---|---|---|
| Initial peak | 0.085 | 0.043 | 0.026 | 0.014 | 0.246 | 0.198 | 0.164 | 0.072 |
| Time to breakdown (sec) | 279.7 | 230.46 | 85.17 | 296.98 | 298.74 | 287.94 | 10.12 | 59.07 |
| Coefficient of Friction | 0.071 | 0.055 | 0.034 | 0.017 | 0.22 | 0.199 | 0.176 | 0.054 |
| Twist Compression Test Friction Factor | 3790 | 4381 | 2629 | 18109 | 1327 | 1448 | 58 | 1026 |

AL—aluminum

The results presented in Table XV demonstrate that the dry films prepared with microalgal biomass were characterized by a lower coefficient of friction than those prepared with graphite. At 5,000 psi, coefficient of friction of sample K-1 on aluminum was 80% lower than that of sample K-2 on aluminum (0.034 vs 0.176). The initial peak is the coefficient of friction when the test reaches full pressure. At 5,000K psi, the initial peak of the microalgal film sample was 84% lower than that of the graphite film sample. "Twist compression test friction factor" is an aggregate measure of the various results obtained from the twist compression test. Higher values of the twist compression test friction factor indicate that the lubricant provides more lubricity. As can be seen above, the twist compression test friction factor for the formulation comprising biomass when applied to steel and subjected to 20,000 psi is 18,109, where for the formulation containing graphite the twist compression test friction factor is 1026. This is a greater than 17-fold increase in the twist compression test friction factor indicating that the formulation comprising biomass is a significantly better lubricant than the control lubricant formulated with graphite. Similarly, the time to breakdown for formulations comprising biomass is significantly greater. The time to breakdown for aluminum at 5,000 psi is 85.17 (biomass formulation) versus 10.12 (graphite formulation), an 8.4 fold increase. Collectively, these data demonstrate the ability of formulations prepared with microalgal biomass to achieve lower friction on aluminum and steel surfaces than those prepared with graphite.

Example 13: Reduced Friction with Algal Biomass Formulations in Oil

This example compares the friction reduction and extreme pressure properties of oil-based formulations containing microalgal biomass to those of formulations containing graphite or molybdenum disulfide under stresses relevant to metalworking fluids.

Prior to formulation, dried microalgal biomass was characterized by properties listed in Table II with the exception that it was prepared to a final average particle size below 100 microns. Suspended forms of solid lubricants were obtained from commercial sources: graphite (Graphkote 495, Asbury Carbon) and molybdenum disulfide (SLA 1286, Henkel). Petroleum-derived Group II base oil, fumed silica, and bismuth octoate were obtained from commercial sources. Weight based formulations were prepared according to the recipes listed in Table XVI. Mixing of sample formulation was achieved with an overhead low shear mixer utilizing a Cowles blade followed by an overhead high shear Silverson mixer until the mixture was uniform. Each of the formulations were characterized by 2.5% solids content. Formulations were stored in glass jars under ambient conditions. They were evaluated according to the extreme pressure test ASTM D 3233 Method A, allowing the load to increase until pin failure. In the absence of pin failure, a load of 3,000 lbs or more was applied. Results of this standardized test are shown in Table XVII.

TABLE XVI

Oil-Based Lubricant Formulations

| Component | | Sample L-1 | Sample L-2 | Sample L-3 |
|---|---|---|---|---|
| Group II Paraffinic Base Oil | Weight % Component of Formulation | 95.2 | 72.7 | 89.2 |
| Dried microalgal biomass | | 2.5 | 0 | 0 |
| naGraphite (Graphkote) | | 0 | 25 | 0 |
| molybdenum disulfide (SLA 1286) | | 0 | 0 | 8.5 |
| Fumed Silica | | 0.1 | 0.1 | 0.1 |
| Bismuth Octoate | | 2.2 | 2.2 | 2.2 |

TABLE XVII

Results of Extreme Pressure Standardized Test

| Test | Measure | Sample L-1 | Sample L-2 | Sample L-3 |
|---|---|---|---|---|
| ASTM D 3233 Method A, Standard Test Methods for Measurement of Extreme Pressure Properties of Fluid Lubricants (Falex Pin and Vee Block Methods) | Coefficient of Friction at end of test or at break | 0.099 | 0.313 | 0.051 |
| | Load at Failure (lbs) | no fail | 1007 | no fail |

The results presented in Table XII demonstrate that the formulations prepared with microalgal biomass, fumed silica and bismuth octoate were able to lubricate the spinning pin to be able to withstand a load of 3,000 or greater and were characterized by a coefficient of friction at the end of the test of 0.099. In contrast, formulations with graphite, fumed silica and bismuth octoate were unable to lubricate the pin above loads of 1007 lbs and were characterized by a coefficient of friction of 0.313.

Example 14: Metal Removal Fluids with Microalgal Oil

This example describes the load carrying and lubricating properties of chlorinated paraffin-free formulations comprising microalgal oil under stresses relevant to metalworking fluids.

Prior to formulation, microalgal oil was characterized by properties listed in Table I (Sample IF, 56697, >88% high oleic content, <2% polyunsaturated content). Lubricant formulations comprising extreme pressure, antioxidant, rust inhibitor, metal deactivator, and viscosity modifier additives were mixed into a vessel charged with microalgal oil to achieve an effective viscosity. Two formulations, M-1 and M-2 were evaluated according to ASTM D 3233 Method B. Results of these standardized tests are listed in Table XVIII.

TABLE XVIII

Results of Extreme Pressure Step Test

| | Formulation M-1 (82.7% Microalgal Oil S6697) | | Formulation M-2 (92% Microalgal Oil S6697 and derivatives) | |
|---|---|---|---|---|
| Load (lbs) | Torque (lbs force) | Temperature (° F.) | Torque (lbs force) | Temperature (° F.) |
| 300 | 7.85 | 85 | 6.8 | 87.5 |
| 500 | 9.25 | 86.5 | 8.9 | 98.5 |
| 750 | 12.55 | 91 | 10.8 | 103.5 |
| 1000 | 14.55 | 93.5 | 12.0 | 108.0 |
| 1250 | 16.3 | 100 | 13.2 | 113.5 |
| 1500 | 17.9 | 105.5 | 14.9 | 120.5 |
| 1750 | 19.6 | 111.5 | 15.5 | 127.5 |
| 2000 | 20.95 | 117 | 16.4 | 131.5 |
| 2250 | 21.8 | 124 | 17.5 | 137.5 |
| 2500 | 22.55 | 133 | 18.7 | 141.5 |
| 2750 | 23.5 | 138.5 | 19.9 | 148.0 |
| 3000 | 24.55 | 145 | 21.0 | 156.0 |
| 3250 | 24.85 | 152 | 22.9 | 163.5 |
| 3500 | 25.7 | 158.5 | 24.5 | 170.0 |
| 3750 | 26.1 | 165 | 25.7 | 176.0 |
| 4000 | 26.15 | 168.5 | 27.1 | 185.0 |
| 4250 | 27.15 | 172 | 27.4 | 194.0 |
| 4500 | 27.1 | 181 | | |

Results presented in Table XVIII demonstrate that formulations with microalgal oil achieve loads of >4,000 lbs and are free of chlorinated paraffins.

Example 15: Reduced Grease Additives with Microalgal Biomass

This example describes the load carrying and wear properties of grease formulations comprising microalgal biomass.

Prior to formulation into greases, dried microalgal biomass was characterized by properties listed in Table II. Weight based grease formulations were prepared according to the recipes listed in Table XIX. 12-hydroxy stearate lithium grease base, chlorinated ester, and technical grade molybdenum disulfide were obtained from commercial sources as indicated in Table XIX below. Grease formulations were prepared by charging a Kitchen Aid Pro 600 with pre-additized lithium 12 grease. The blender was brought to a medium orbital speed of 40 rpm. The grease was then further charged with either molybdenum disulfide chlorinated ester, sifting in to assure dispersion. Mixing was allowed to proceed for 1 hour or until a homogeneous grease blend was achieved. The grease formulations as indicated were then further charged with dried microalgal biomass. Mixing continued for a minimum of one hour. Formulations were evaluated by cone penetration (ASTM D217) before and after exposure to 1,000 cycles in a Koehler K18100 Grease Worker. ASTM D 2266 Four-Ball wear testing was conducted on 20 gram worked samples. Results of these standard tests are shown in Table XX.

TABLE XIX

Grease Formulations

| Formulation | N-1 Grease with Chlorinated Paraffin | N-2 Grease with Chlorinated Paraffin and Microalgal biomass | N-3 Grease with Molybdenum Disulfide | N-4 Grease with Molybdenum Disulfide and Microalgal biomass |
|---|---|---|---|---|
| | wt % of Formulation | | | |
| #2 Lithium grease base (Battenfeld) | 95 | 94.5 | 99 | 98.5 |
| Chlorinated Ester (Qualice) | 5 | 3.5 | 0 | 0 |
| Molybdenum disulfide (Gamay Ind.) technical 5 um X bar | 0 | 0 | 1 | 0.5 |
| Dried microalgal biomass | 0 | 2 | 0 | 1 |

TABLE XX

Results of ASTM D 2266: Wear Preventative Pressure Characteristics of Lubricating Grease

| | Grease Base with Qualice Chlorinated Paraffin | | Grease Base with Gamay Ind. Molybdenum Disulfide | |
|---|---|---|---|---|
| Measure | N-1 | N-2 | N-3 | N-4 |
| Load wear Index | 42 | 37 | 46 | 40 46 |
| Exteme Pressure Weld (kg) | 400 | 400 | 250 | 250 |

The results shown in Table XX demonstrate that microalgal biomass may be used to lower the amount of chlorinated paraffin or the amount of molybdenum disulfide in grease formulations while maintaining near identical wear and weld properties.

Example 16: Reduced Wear with Microalgal Biomass

This example describes improved wear properties of metalworking formulations comprising microalgal biomass.

Prior to formulation, dried microalgal biomass was characterized by properties listed in Table II. Where indicated in Table XXI, 10% by weight microaglal biomass was blended into 90% by weight metalworking formulation. Formulations were blended with a handheld Master Mix and then evaluated by ASTM D 2670, Standard Test Method for Measuring Wear Properties of Fluid Lubricants (Falex Pin and Vee Block Method). Tooth wear as well as final torque and final temperature are provided in Table XXI.

TABLE XXI

Metalworking Formulations and Results of ASTM D 2670

| ASTM D2670 | Weight % Microalgal Biomass | Final Torque (lb force) | Final Temperature (° F.) | Tooth Wear (teeth) |
|---|---|---|---|---|
| Battenfield Lithium | 0 | 17.4 | 221 | 120 |
| General Purpose Grease | 10 | 15.4 | 222 | 22 |
| Qualice Chlorinated | 0 | 18.2 | 142 | 21 |
| Tapping Fluid | 10 | 17.9 | 149 | 6 |

The results shown in Table XXI demonstrate that microalgal biomass may be used to reduce wear in grease and in tapping fluids.

Example 17: Lubricant Formulations

Additional lubricant formulations are shown in Table XXII below.

TABLE XXII

Lubricant formulations

| Formulation | Components |
|---|---|
| Water Based Concentrate | 25% microalgae; 1.5% CMC (FinnFix LC); 0.5% Tergitol min foam; 0.5% Proxel GXL; 72.5% Water; NaOH to pH 9.5 |
| Oil Based Concentrate | 25% microalgae; 1% Hydrophilic Fumed Silica (Cabosil M5); 74% Calsol 5550 (Calumet; Naphthenic Oil, treated for color and volatiles) |
| Water and Oil Based Concentrate | 25% microalgae; 12.5% Chemfac PB-184 (phosphate ester based emulsifier); 12.5% deionized water; 1% Hydrophilic Fumed Silica (Cabosil M5); 50% HC100 (Calumet Naphthenic Oil) |
| Delipidated and acid/base digested microalgal biomass Concentrate | 50% solids from pressing; 50% Water; $H_2SO_4$ as acid for digest; NaOH as base for digest |

Although this invention has been described in connection with specific embodiments thereof, it will be understood that it is capable of further modifications. This application is intended to cover any variations, uses, or adaptations of the invention following, in general, the principles of the invention and including such departures from the present disclosure as come within known or customary practice within the art to which the invention pertains and as may be applied to the essential features hereinbefore set forth.

All references cited herein, including patents, patent applications, and publications are hereby incorporated by reference in their entireties, whether previously specifically incorporated or not.

What is claimed is:

1. A lubricant comprising an oleaginous microbial biomass, wherein the oleaginous microbial biomass consists essentially of intact cells comprising at least 50% triglyceride oil by dry cell weight.

2. The lubricant of claim 1, wherein the lubricant is selected from the group consisting of a spray oil, food grade lubricant, a railroad lubricant, a gear lubricant, a bearing lubricant, crankcase lubricant, a cylinder lubricant, a compressor lubricant, a turbine lubricant, a chain lubricant, an oven chain lubricant, wire rope lubricant, a conveyor lubricant, a combustion engine lubricant, an electric motor lubricant, a total-loss lubricant, a textile lubricant, a heat transfer fluid, a release agent, a hydraulic fluid, a metal working fluid, and a grease.

3. The lubricant of claim 1, comprising one or more of an anti-oxidant, a corrosion inhibitor, a metal deactivator, a binder, a chelating agent, a metal chelator, an oxygen scavenger, an anti-wear agent, an extreme pressure resistance additive, an anti-microbial agent, a biocide, a bacteriocide, a fungicide, a pH adjuster, an emulsifier, a lubricity agent, a vegetable oil, a petroleum derived oil, a high viscosity petroleum hydrocarbon oil, a petroleum derivative, a pour point depressant, a moisture scavenger, a defoamer, an anti-misting agent, an odorant, a surfactant, a humectant, a rheology modifier, or a colorant.

4. The lubricant of claim 1, wherein the lubricant is a cutting lubricant, a gun drilling lubricant, stamping lubricant, a metal forming lubricant, or a way lubricant.

5. The lubricant of claim 1, comprising one or more of a napthenic oil, a paraffinc oil, a fatty acid ester, a high molecular weight ester, a glycol ester, an ethylene oxide copolymer, a polypropylene oxide copolymer, a naturally occurring triglyceride, graphite, graphite fluoride, molybdenum disulfide, tungsten disulfide, tin sulfide, boron nitride.

6. The lubricant of any of claim 1, wherein the oleaginous microbial biomass is a microalga.

7. The lubricant of claim 6, wherein the microalgae is of the genus *Prototheca, Auxenochlorella, Chlorella*, or *Parachlorella*.

8. The lubricant of claim 7, wherein the microalgae is of the species *Prototheca moriformis*.

9. The lubricant of claim 1, wherein the triglyceride oil has a fatty acid profile comprising at least 75% C18:1.

10. The lubricant of claim 1, wherein the triglyceride oil has a fatty acid profile comprising less than 4% polyunsaturated fatty acids.

11. The lubricant of claim 1, wherein the triglyceride oil has a fatty acid profile comprising greater than 55% 18:1.

12. The lubricant claim 1, wherein the oil has a fatty acid profile of greater than 50% combined C10:0 and C12:0.

13. The lubricant of claim 1, wherein the triglyceride oil has a fatty acid profile comprising at least 20% C18.

14. A method for providing lubrication to a metal surface, the method comprising applying a lubricant to the surface, the lubricant comprising an oleaginous microbial biomass, wherein the oleaginous microbial biomass consists essentially of intact cells comprising at least 50% triglyceride oil.

15. The method of claim 14, wherein the lubricant forms a film on the surface.

16. The lubricant of claim 1, wherein the intact cells have a particle size distribution d50 value of from 100 to 500 μm, wherein the d50 value is the median diameter of particle size distribution at 50% of the distribution, where 50% of the particles are above the d50 value and 50% are below the d50 value.

17. The lubricant claim 16 wherein the d50 value is from 200 to 400 μm.

18. The lubricant claim 17 wherein the d50 value is from 300 to 400 μm.

19. The lubricant of claim 1, wherein the lubricant has a decreased health risk compared to solid film lubricants that do not comprise intact oleaginous microbial biomass.

20. The lubricant of claim 1, wherein the lubricant can be more easily removed from a surface in contact with the lubricant after use compared to solid film lubricants that do not comprise intact oleaginous microbial biomass.

* * * * *